US005127822A

United States Patent [19]

Nakayama et al.

[11] Patent Number: 5,127,822

[45] Date of Patent: Jul. 7, 1992

[54] COMBUSTION APPARATUS WITH ATOMIZER AND METHOD OF CONTROLLING SAME

[75] Inventors: Kouji Nakayama; Kiyoe Ishikawa; Hirokazu Takenaka; Hitoshi Kurokawa, all of Tokyo, Japan

[73] Assignee: Toa Nenryo Kogyo Kabushiki Kaisha, Tokyo, Japan

[21] Appl. No.: 626,330

[22] Filed: Dec. 13, 1990

Related U.S. Application Data

[63] Continuation of Ser. No. 231,555, Aug. 21, 1988, abandoned.

[30] Foreign Application Priority Data

| | | | |
|---|---|---|---|
| Aug. 14, 1987 | [JP] | Japan | 62-202974 |
| Aug. 18, 1987 | [JP] | Japan | 62-204862 |
| Aug. 19, 1987 | [JP] | Japan | 62-205861 |
| Aug. 19, 1987 | [JP] | Japan | 62-205862 |
| Aug. 19, 1987 | [JP] | Japan | 62-205863 |
| Jan. 29, 1988 | [JP] | Japan | 63-11828 |
| Jan. 29, 1988 | [JP] | Japan | 63-11829 |
| Jan. 29, 1988 | [JP] | Japan | 63-11830 |
| Jan. 29, 1988 | [JP] | Japan | 63-11831 |
| Jan. 29, 1988 | [JP] | Japan | 63-11832 |
| Jan. 29, 1988 | [JP] | Japan | 63-20982 |
| Apr. 18, 1988 | [JP] | Japan | 63-51995 |
| May 11, 1988 | [JP] | Japan | 63-61955 |

[51] Int. Cl.[5] ..... F23D 11/00; F23D 11/34

[52] U.S. Cl. ..... 431/10; 431/1; 431/11; 431/6; 431/117; 431/207; 431/242; 431/350; 126/93; 126/95

[58] Field of Search ..... 431/1, 6, 8, 10, 11, 431/62, 117, 190, 214, 207, 213, 242, 243, 238, 239, 330, 333, 350, 354, 247, 248, 351, 352; 60/738, 743, 758, 760; 126/93, 95

[56] References Cited

U.S. PATENT DOCUMENTS

| | | | |
|---|---|---|---|
| 427,819 | 5/1890 | Adams | 126/95 |
| 1,052,588 | 2/1913 | Janicki | 60/743 X |
| 1,553,661 | 9/1925 | Becker | 431/10 |
| 1,760,007 | 5/1930 | Schaller | 431/117 X |
| 2,541,900 | 2/1951 | Williams | 60/738 |
| 2,638,160 | 5/1953 | Thomson | 431/333 X |
| 3,277,945 | 10/1966 | Vermes | 431/330 X |
| 4,389,185 | 6/1983 | Alpkrist | 431/243 X |
| 4,392,810 | 7/1983 | Beans et al. | 431/11 X |
| 4,595,356 | 6/1986 | Gaysert et al. | 431/1 X |

FOREIGN PATENT DOCUMENTS

| | | | |
|---|---|---|---|
| 63-49608 | 3/1968 | Japan . | |
| 0121310 | 9/1980 | Japan | 431/169 |
| 126368 | 10/1949 | Sweden | 431/330 |
| 311127 | 1/1956 | Switzerland | 431/330 |
| 902893 | 8/1962 | United Kingdom | 431/242 |

*Primary Examiner*—Carl D. Price

*Attorney, Agent, or Firm*—Armstrong, Nikaido, Marmelstein, Kubovcik & Murray

[57] ABSTRACT

Provided is an atomizer-equipped combustion apparatus including an atomizing device for atomizing a fuel, a spray chamber for mixing the fuel atomized by the atomizing device with air to form a mixture, and for moving the mixture downwardly toward an opening at a distal end portion of the spray chamber, and a wind box provided so as to surround a lower portion of the spray chamber for forming a combustion space between itself and the spray chamber, the wind box being provided with a plurality of air supply holes facing a lower portion of the spray chamber. A mixture of external air and a fine spray of fuel produced by the atomizer can be ignited instantaneously by means of a comparatively simple structure, odors produced at igition and extinguishment can be greatly suppressed and a high turndown ratio can be obtained.

16 Claims, 27 Drawing Sheets

| | SECONDARY AIR | MIST GENERATION TIME |
|---|---|---|
| | 15 (NL/min) | 4 (sec.) |
| | 20 | 4 |
| STARNDARD CONDITIONS → | 25 | 0 |
| | 30 | 0 |

COMBUSTION APPARATUS WITH ATOMIZER AND METHOD OF CONTROLLING SAME

This application is a continuation of application Ser. No. 231,555 filed Aug. 12, 1988 now abandoned.

BACKGROUND OF THE INVENTION

This invention relates to a combustion apparatus, which is equipped with an atomizer, applicable to the combustor of, e.g., a fan heater, boiler, hot water supply device, drier or gas turbine. The invention also relates to a method of controlling the combustion apparatus.

Since a combustor used in a variety of heating apparatus such as oil stoves and fan heaters and in a variety of driers generally is placed in an office or in a residential building such as a private home, various measures have been tried for the purpose of preventing living spaces from becoming contaminated or malodorous. For example, a system has been developed in which the combustor is provided with heating means such as a heater for gasifying the externally supplied fuel. However, it has become clear that some time (at least 30–40 seconds, and as long as 2–3 minutes in many cases) is needed for the fuel to gasify, and that some time therefore is also required for the fuel to ignite.

In order to solve these problems, the applicants amongst others have proposed various systems for the purpose of shortening ignition time by hastening the speed at which the gas of vaporized fuel is produced within a combustion chamber. Specifically, in a proposed arrangement, an atomizer, e.g., an ultrasonic atomizing device comprising a high-frequency oscillator, an electroacoustic transducer and an ultrasonic oscillator horn is provided at the lower portion of a combustion chamber. By exciting this ultrasonic atomizing device into operation, the fuel supplied to the combustion chamber is atomized into very fine droplets, thereby accelerating vaporization of the fuel in the combustion chamber and, hence, reducing the time needed for steady combustion of the fuel.

However, combustion tests using this conventional combustor having the ultrasonic atomizing device provided at the lower portion of the combustion chamber have shown that while the time required for combustion at the lower portion (namely the vaporizing compartment) of the combustion chamber having the ultrasonic atomizing device is indeed greatly curtailed in comparison with the prior art, the flame produced in the vaporizing compartment travels to the overlying combustion chamber, where a steady-state flame is formed. It has been confirmed that some time, on the order of 10–30 seconds, is required for the steady-state flame to be formed from the moment of fuel ignition in the vaporization compartment, and that odors and soot are produced to some degree until the steady-state flame is formed. Furthermore, in this proposed combustion apparatus equipped with the ultrasonic atomizing device, the structure of the combustor itself is complicated, and it has been clarified that the turn-down ratio (the ratio of maximum amount of combustion to minimum amount of combustion), which represents the maximum adjustment range of the amount of combustion, can be set to only 2:1.

In addition, though the combustion apparatus with the atomizer can be applied to a so-called line-type combustor the entirety of which generally has the shape of a rectangular parallelepiped, and though this arrangement greatly contributes to a more slender apparatus, a problem encountered is that a blue flame cannot be maintained at the end of the flame hole.

In the prior-art combustion apparatus with the atomizer, droplets form and attach themselves to the wall surface of the vaporization compartment when ignition is delayed by low temperatures. These droplets grow, flow downwardly and drop onto the combustion plate, clogging its air holes. The result is a yellowish flame of extended length. This causes a disturbance in the combustion process and leads to problems in terms of achieving stable combustion.

Since the conventional combustion apparatus has a combustion space formed in only two sides or, in some cases, in one side, the apparatus must be increased in size in order to enlarge the combustion space.

In the case of the so-called line-type combustor the entirety of which generally has the shape of the rectangular parallelepiped, the combustion space is long and narrow. Consequently, the side walls of a spray chamber thermally expand due to the heat of combustion and the atomization chamber becomes deformed. As a result, the flame distribution is disturbed, combustion becomes non-uniform and a red flame is produced.

Furthermore, since the combustion space is long and narrow, air which is injected from air supply holes provided in a wind box is non-uniform at the entrance and inner confines of an air passageway. As a result, a disturbance is produced in the distribution of the flame. This leads to non-uniform combustion and the production of a red flame, which is undersirable. Furthermore, another problem is that when only a small amount of secondary air flows in the steady state, unburned gas flows backwardly into a secondary air duct, causing tar deposits to form.

When the flame is extinguished in the conventional combustion apparatus, some of the fuel which has been supplied up to the distal end portion of a fuel supply pipe facing the oscillator horn of the atomizer drips into the spray chamber via the oscillator horn due to thermal expansion and a drop in surface tension and viscosity caused by heating several seconds after the fuel pump is turned off. This phenomenon is referred to as flashback and results in incomplete combustion and the formation of soot. The unburned raw gas produced is discharged and leads to the formation of tar that deposits on the oscillator horn. The end result is a decline in the fuel atomization efficiency and the production of odors.

Other problems that remain involve the uniformity of flame distribution, a rise in the temperature of the spray chamber and the exhaust gas characteristics at the time of incomplete combustion.

SUMMARY OF THE INVENTION

An object of the present invention is to provide an atomizer-equipped combustion apparatus, and a method of controlling the same, in which a mixture of external air and a fine spray of fuel produced by an atomizer can be ignited instantaneously by means of a comparatively simple structure, odors produced at ignition and extinguishment can be greatly suppressed and a high turn-down ratio can be obtained.

In accordance with the present invention, the foregoing object is attained by providing a combustion apparatus characterized by comprising an atomizing device for atomizing a fuel into fine droplets, a spray chamber for forming a fuel/air mixture of the fine droplets and air, wherein the fuel/air mixture is moved downward toward an opening at a distal end portion of the spray chamber, and a wind box for supplying combusion air to the fuel/air mixture through a plurality of holes bored in the cover plate of the wind box, the cover plate extending over the opening and lower portion of the spray chamber to form a combustion space between itself and the spray chamber.

Further, in accordance with the invention, there is provided a method of regulating air flows for a combustion apparatus which combusts a fuel with primary, secondary and tertiary air, comprising an atomizing device for atomizing a fuel into fine droplets, the atomizing device being supplied with primary air, a spray chamber for forming a fuel/air mixture of the fine droplets and air, wherein the fuel/air mixture is moved downward toward an opening at a distal end portion of the spray chamber, and a wind box for supplying secondary and tertiary air to the fuel/air mixture through a plurality of holes bored in a cover plate of the wind box, the cover plate extending over the opening and lower portion of the spray chamber to form a combustion space between itself and the spray chamber, wherein flows of the primary and secondary air are regulated so as to sustain stable combusion at any stage of combustion.

Accordingly, when applied to the so-called line-type combustor the entirety of which generally has the shape of a rectangular parallelepiped, the invention contributes to a more slender apparatus and causes the entirety of the flame produced to be a blue flame uniform in the longitudinal direction.

The invention also makes it possible to prevent a delay in ignition at low temperatures (e.g. below the freezing point) as well as the production of strong odors. Stable initial combustion can also be obtained.

Further, by preventing thermal deformation of the spray chamber and absorbing thermal expansion of the side walls of the spray chamber, deformation of these side walls can be prevented so that the flow of gas resulting from fuel vaporization can be uniformaly maintained.

By forcibly cooling the spray chamber, the invention prevents overheating of the spray chamber interior and flashback, thereby stabilizing combustion, preventing high-temperature oxidation of the spray chamber side walls and improving durability.

Since the amount of secondary air expelled from secondary air holes can be uniformly maintained through a simple structure, combustion can also be carried out in a uniform manner and the distribution of the flame can be held constant. Also, since the interior of a secondary air supply duct is maintained at a positive pressure, backward flow of unburned gas can be prevented.

Furthermore, in accordance with the invention, fuel at the distal end of a fuel supply pipe can be instantaneously returned to a fuel tank when the flame is extinguished. This not only prevents after-burning and improves extinguishability but also shortens the time needed to start combustion again.

By constricting an outlet passage of the spray chamber, the mixing of air and fuel is promoted and a more uniform flame distribution can be obtained.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figure 1:
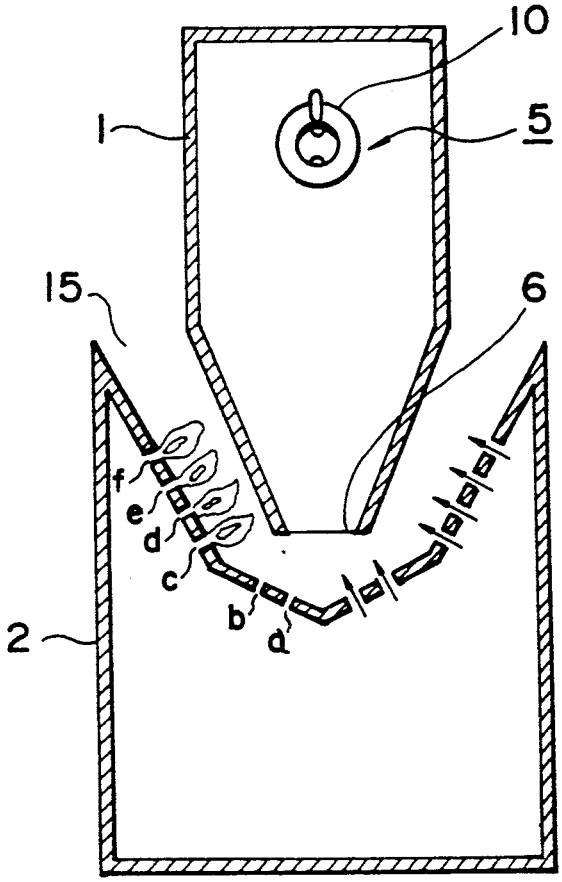
FIG. 1 is a sectional view illustrating a first embodiment of a combustion apparatus with an atomizer according to the present invention.
Figure 2:
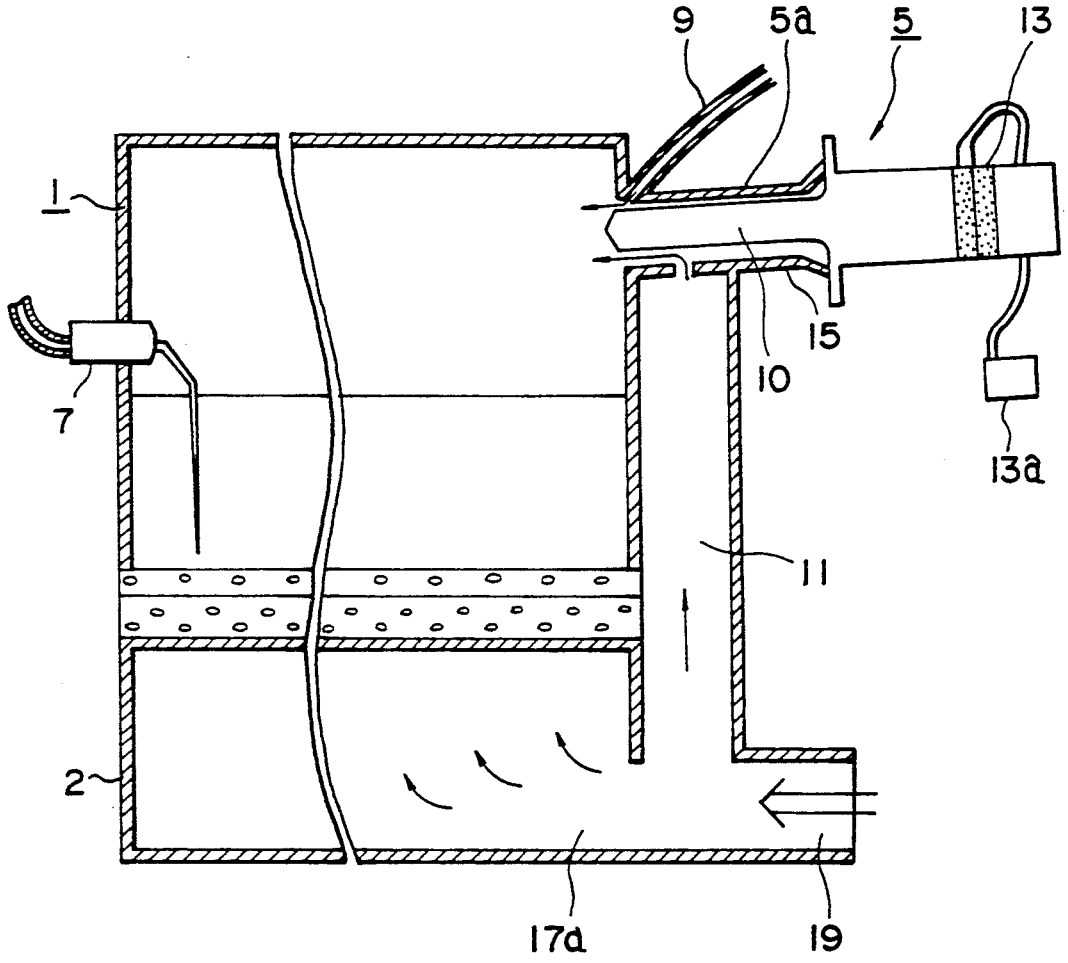
FIG. 2 is a longitudinal sectional view of the apparatus shown in FIG. 1.

FIGS. 1 and 2 illustrate an embodiment of an atomizer-equipped combustion apparatus according to the present invention. The apparatus is a so-called line-type combuster the entirety of which generally has the shape of a rectangular parallelepiped and which employs an ultrasonic atomizing device as the atomizer. The combustor includes a spray chamber 1 defining a first housing, a wind box 2 defining a second housing, an ultrasonic atomizing device 5, an igniter 7 serving as an igniting means, and an air supply duct for introducing outside air to the spray chamber 1 and wind box 2.

Atomized fuel droplets produced by ultrasonic oscillation of the ultrasonic atomizing device 5 and primary air (which refers to air necessary for forming a mixture with the atomized fuel) provided via the air supply duct 19 are mixed within the spray chamber 1. The spray chamber 1 in this specific embodiment is gradually constricted downstream in the direction of movement of the aforementioned mixture so as to form a generally V-shaped configuration the distal end whereof has a prescribed opening 6. The igniting portion of the igniter 7 (FIG. 2) is disposed near the opening 6.

An ultrasonic injection nozzle 5*a* constituting the ultrasonic atomizing device 5 faces the upper part of the spray chamber 1. As shown in FIG. 2, the ultrasonic injection nozzle 5*a* is in communication with the interior of the spray chamber 1 and also communicates via a very small aperture with the interior of a primary air supply duct 11 branching from the air supply duct 19. The ultrasonic injection nozzle 5*a* has an ultrasonic horn 10 the distal end whereof faces the interior of the spray chamber 1, and a fuel supply pipe 9 for supplying a liquid fuel to an atomizing region of the oscillator horn 10. As well known in the art, the ultrasonic atomizing device 5 includes an electroacoustic transducer 13 for converting a signal outputted by a high-frequency oscillator 13*a* into ultrasonic oscillations, whereby the fuel supplied to the atomizing region of the oscillator horn 10 is formed into a spray. In the illustrated embodiment, the oscillator horn 10 is of a type whose distal end is conical in shape, though the invention is not limited to this configuration.

As shown in FIG. 1, the wind box 2 is formed to have a substantially V-shaped recess at its upper portion corresponding to the generally V-shaped constricted portion of the spray chamber 1. A combustion space 15 is defined between the upper surface of the wind box 2 and the spray chamber 1. The upper portion of the wind box 2 is formed to have left-right symmetry about the opening 6 of the spray chamber 1, slants at a small angle from the bottom over a fixed distance and then rises at a sharp angle. The lower portion of the wind box 2 is formed to have a secondary and tertiary air supply duct 17*a* branching from the air supply duct 19 and adapted to feed secondary air (combustion air for maintaining an ignited state) and tertiary air (combustion air for maintaining a steady combustion state) into the wind box 2.

In the illustrated embodiment, the substantially V-shaped space 15 is defined by the outer wall surface of the constricted portion of the spray chamber 1, the outer wall surface of the upper portion of wind box 2, and part of an outer housing of the combustor, not shown. The space 15 is designed to function as a combustion space when a steady combustion state prevails. As for the generally V-shaped portion of the wind box 2, the part having the slight incline is provided with two rows of secondary air holes a, b having left-right symmetry about the opening 6. The part having the steep incline extending upwardly from the location of the secondary air holes a, b is provided with four rows of tertiary air holes c, d, e and f also having left-right symmetry about the opening 6.

In the illustrated embodiment, the secondary air holes a, b each have a hole diameter of 0.8 mm. There are 16 of the secondary air holes a per row and 17 of the secondary air holes b per row. The holes in these rows are arranged in staggered fashion. The tertiary air holes c through f each have a hole diameter of 1.2 mm. There are 32 of the tertiary air holes c and e per row and 33 of the tertiary air holes d, f per row. The holes in these rows are arranged in staggered fashion. It should be noted that this illustrates only one example of the diameters, numbers of holes and numbers of rows of the secondary air holes a, b and tertiary airholes c through f, and that various modifications can be made in this respect.

The amounts of primary air supplied to the ultrasonic injection nozzle 5*a* via the primary air supply duct 11, secondary air supplied to the substantially V-shaped space 15 via the secondary air holes a, b and tertiary air supplied to the substantially V-shaped space 15 via the tertiary air holes c through f are varied in dependence upon the amount of fuel supplied from the fuel supply pipe 9. For example, if fuel is supplied at a rate of 5 cc/min, a primary air flow rate of about 1–3 NL/min, a secondary air flow rate of about 5–10 NL/min and a tertiary air flow rate of about 70–80 NL/min would be appropriate.

The manner in which combustion is achieved in the atomizer-equipped combustion apparatus of the present invention will now be described with regard to ignition, steady combustion and extinguishment processes.

IGNITION

When fuel is supplied to the atomizing region of the oscillator horn 10, the fuel is atomized (SMD 40 um) and converted into a spray by ultrasonic oscillation. The fuel spray is injected into the spray chamber 1 while being preliminarily mixed with the primary air flowing in from the primary air supply duct 11. The injected preliminary mixture travels downwardly in the spray chamber 1 and is ignited by the igniter 7 to be formed into a high-temperature gas together with the air already residing within the spray chamber 1. Since the air already residing in the spray chamber 1 is entirely consumed in the course of high-temperature gas formation, the flame within the spray chamber 1 cannot be maintained over an extended period of time and immediately dies out (in about 0.1 sec).

However, despite this extinguishment of the flame, the high-temperature gas produced by the initial combustion described above remains within the spray chamber 1. As a result, some of the fuel spray which continues to be injected into the spray chamber 1 from the ultrasonic injection nozzle 5*a* is gasified by the heat of the high-temperature gas so that downward travel of gasified fuel within the spray chamber 1 continues. This gasified fuel mixes with the secondary air that flows in via opening 6 and secondary air holes a, b and the mixture is reignited by the igniter 7, whereby a flame is generated in the vicinity of the secondary air holes a, b to produce the state shown in (a) of FIG. 3.

Part of the flame travels upward along the substantially V-shaped space 15 from the secondary air holes a, b to heat the outer wall surface of the spray chamber 1, and the rest of the flame moves as is into the spray chamber 1. Thus, the spray chamber 1 is heated both internally and externally to further raise the temperature therein, thereby promoting further gasification of the preliminary mixture. The time required to attain this process for further elevating the temperature within the spray chamber 1 after the preliminary mixture is first fed into the chamber 1 from the ultrasonic injection nozzle 5*a* is on the order to about 3–4 seconds.

When the gasification of the preliminary mixture is facilitated by further elevation of the temperature within the spray chamber 1, the amount of gas sprayed out of the spray chamber 1 via the opening 6 gradually increases, so that the production of the flame does not stop at the secondary air holes a, b but successively spreads to the tertiary air holes c through f. When the flame is thus produced at the tertiary air holes c through f, the outer wall surface of the spray chamber 1 is heated directly by the flame. As a consequence, the temperature prevailing within the spray chamber 1 rises rapidly so that all of the preliminary mixture supplied from the ultrasonic injection nozzle 5*a* is gasified. The time needed to gasify all of the preliminary mixture after the mixture is first fed into the spray chamber 1 is about 20 seconds. When this state is attained, the amount of gas expelled from the spray chamber 1 toward the secondary air holes a, b via the opening 6 is excessive, as a result of which the flame at the secondary air holes a, b is extinguished. The flame is maintained only at the tertiary air holes c through f. This represents a transition from the ignition state to a thermally stable state, namely the steady combustion state.

STEADY COMBUSTION

At the transition from ignition to steady combustion, the heat for gasifying the preliminary mixture of the fuel spray and primary air fed into the spray chamber is entirely provided due to heating of the external wall surface of the spray chamber 1 by the flame produced at the tertiary air holes c through f, as described above. In this case the flame is not produced directly by the prelimiary air and secondary air but this air does mix in with the gas produced in the spray chamber 1 to form a slight preliminary mixture component. Furthermore, the flow velocity of the gas which has attained the aforementioned prelimiary mixture state increases by an amount corresponding to the volume of the preliminary and secondary air so that there is an increase in the pressure differential at the combustion space 15. As a result, the stability of the blue flame is heightened and the distribution of the flame can be maintained in a favorable state.

Figure 3A:
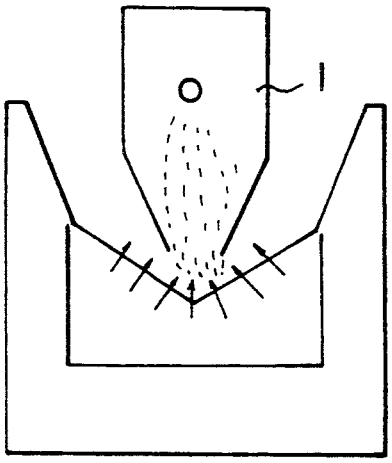
FIGS. 3(*a*) and (*b*) are views useful in describing a combustion state.
Figure 3B:
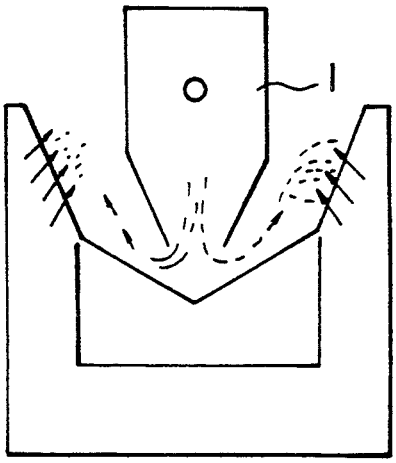
Figure 4:
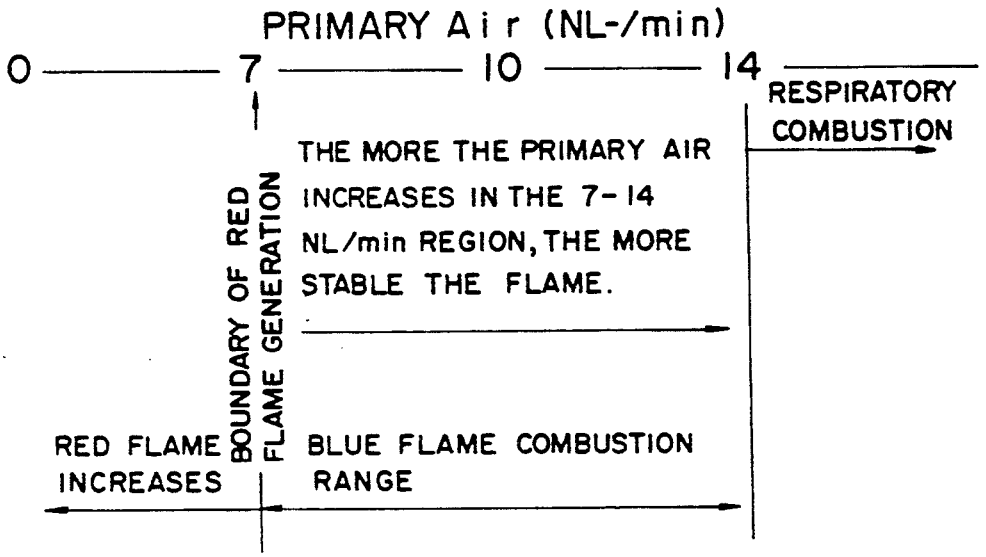
FIGS. 4 through 6 are views showing the relationship between primary, secondary and tertiary air flow rates and the state of combustion.

The basic combustion pattern at steady combustion is a so-called "diffused combustion" pattern in which a flame is produced at each of the tertiary air holes c through f, as shown at (b) in FIG. 3. Therefore, even if the overall amount of air that flows into the combustor cannot be varied, flames are generated at all of the tertiary air holes c through f near the rated output of the external combustor and the amount of tertiary air which produces the flames decreases in order from air hole f to air hole c as the output of the combustor is reduced. Accordingly, an increase or decrease in the tertiary air which produces the flames can be made to correspond to an increase or decrease in the amount of combustion in the combustor, so that the turn-down ratio can be significantly increased over that of the conventional combustor. It should be noted that if the amount of air that flows into the combustor can be varied in dependence upon the amount of fuel supplied, then it will of course be possible to obtain an even larger turn-down ratio.

EXTINGUISHMENT

If the supply of fuel from the fuel supply pipe is stopped, the flames being produced at all of the tertiary air holes c through f are immediately extinguished in order from air hole f to air hole c and, in their place, flames are produced only at the positions of the secondary air holes a and b whose flames had, until then, been in the extinguished state. The flames produced at the secondary air holes a and b penetrate the interior of the spray chamber 1 to completely combust the gas which remains in the spray chamber 1 together with the primary air that flows in via the ultrasonic injection nozzle 5*a*. Accordingly, incomplete combustion at the time of extinguishment can be prevented, thereby preventing the production of odors caused by incomplete combustion. Furthermore, the time required for extinguishment is 3–4 seconds from the moment the fuel supply is cut off.

Figure 5:
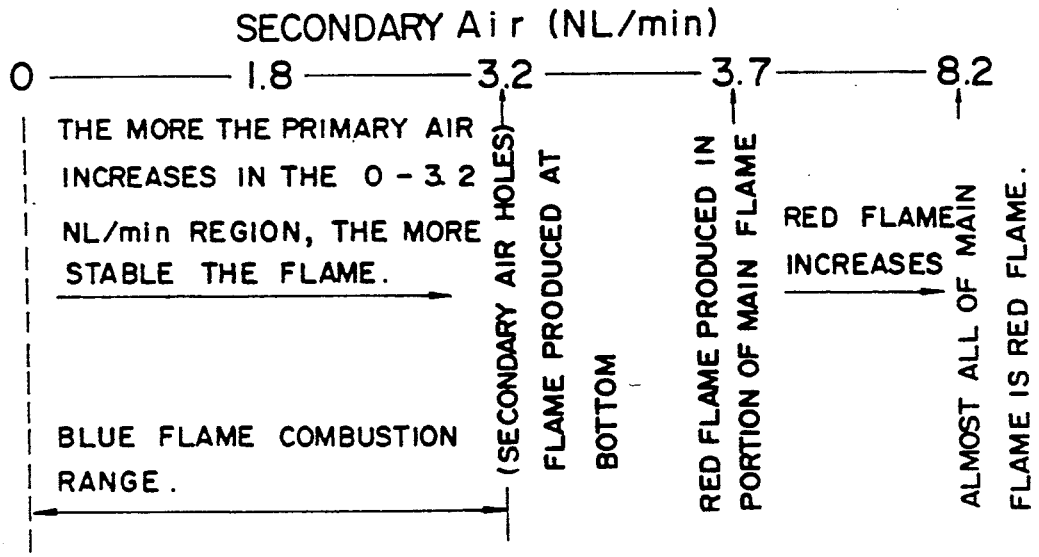
Figures 6, 7:
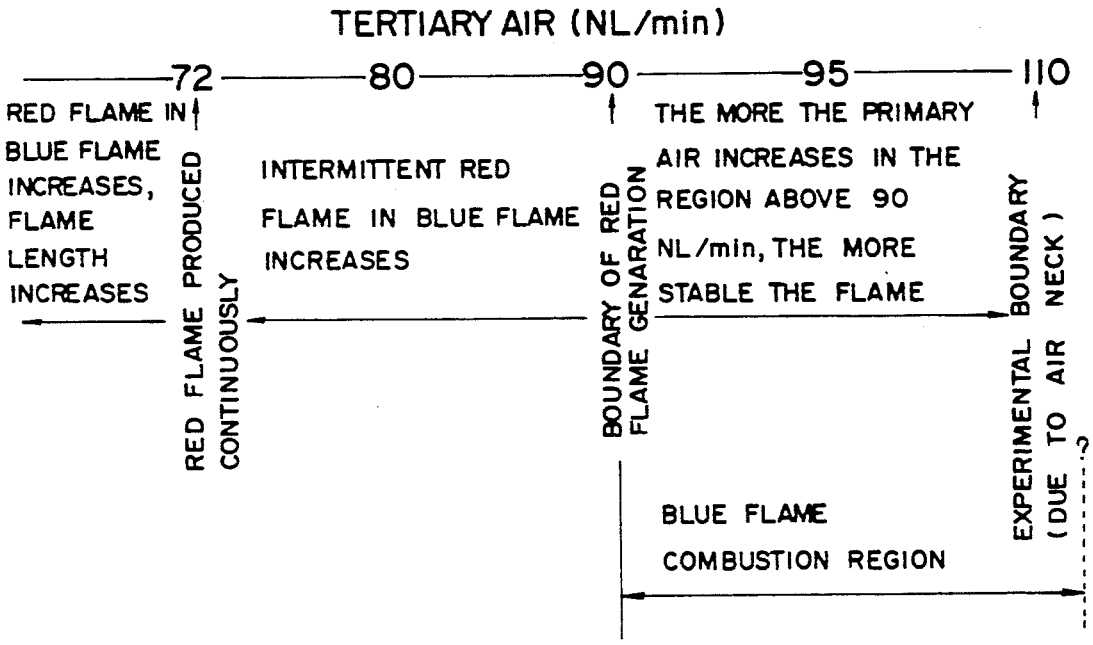
FIG. 7 is a view showing the relationship between mist generation time and secondary air flow rate.

FIGS. 4 through 7 illustrate combustion states which prevail when only one condition is changed at an amount of combustion of 2300 Kcal, a primary air flow rate of 10 NL/min, a secondary air flow rate of 1.8 NL/min, and a tertiary air flow rate of 95 NL/min. It will be understood from FIG. 4 that the flame is stablized at a primary air flow rate of 7–14 NL/min, with a red flame being produced at a flow rate below 7 NL/min and respiratory combustion occuring at a flow rate above 14 NL/min. FIG. 5 shows that the flame is stablized at a secondary air flow rate in the range 0–3.2 NL/min, with a red flame being produced at a flow rate above 3.2 NL/min. FIG. 6 shows that the flame is stablized at a tertiary air flow rate in the range 90–110 NL/min, with a red flame being produced at a flow rate below 90 NL/min.

FIG. 7 illustrates the results of experiments regarding the secondary air and shows that a mist is produced at a flow rate of 20 NL/min.

Figure 8:
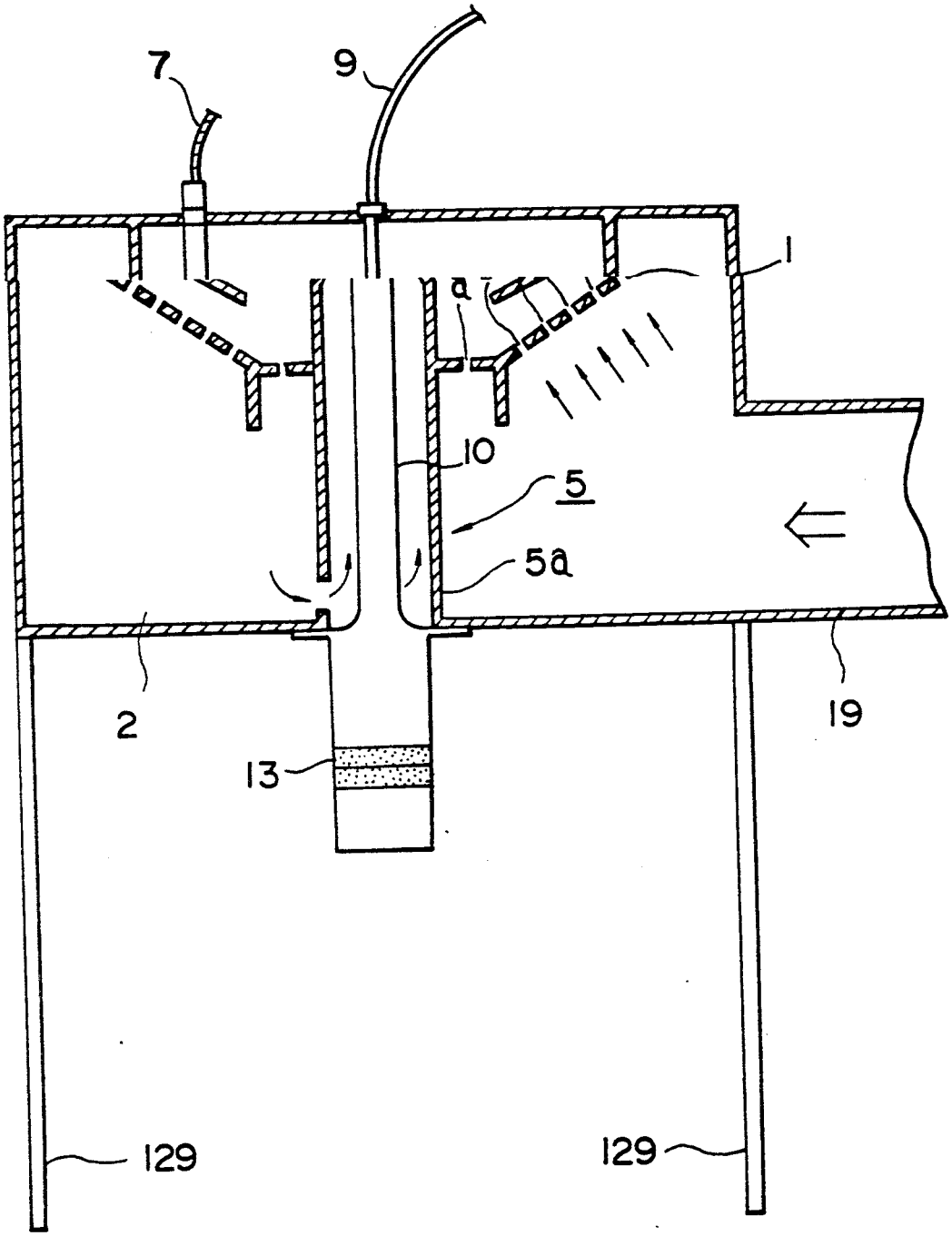
FIG. 8 is a sectional view illustrating a second embodiment of the present invention.

FIG. 8 illustrates a second embodiment of the atomizer-equipped combustion apparatus of the present invention. Here the combustion apparatus is of the so-called round type having an overall configuration which is approximately cylindrical. This embodiment differs from the first embodiment in that a horn the distal end of which is trumpet-shaped is employed as the oscillator horn 10, which in this case is disposed pointing upwardly from the bottom of the spray chamber 1; the distal end of the fuel supply pipe 9 is arranged at the distal end of the oscillator horn 10; the diameter of each secondary air hole a is 0.7 mm and the number thereof is 20; the diameter of each secondary air hole b is 1.2 mm and the number thereof is 40; the diameter of each tertiary air hole c is 1.2 mm and the number thereof is 45; the diameter of each tertiary air hole d is 1.2 mm and the number thereof is 60; the diameter of each of the tertiary air holes e, f is 1.4 mm and the number thereof is 60; the tertiary air holes d, e and f are arranged in staggered fashion; and the inclined portion of the spray chamber 1 and the upper portion of the wind box 2 are formed to have smooth slanted surfaces having a small angle of inclination. The atomizer-equipped combustion apparatus of this embodiment is supported by three legs 129.

A third embodiment of the present invention will now be described with reference to FIGS. 9 and 10, in which portions similar to those of the embodiment shown in FIGS. 1 and 2 are designated by like reference characters and need not be described again.

In this embodiment, the upper surface of the wind box 2 is provided, in staggered fashion and with left-right symmetry with respect to the opening 6 of the spray chamber 1, with three rows each of secondary air holes a–c and five rows each of tertiary air hole d–h.

Provided within the wind box 2 are a secondary air supply duct 16 and a tertiary air supply duct 17 branching from the air supply duct 19. The secondary air holes a–c communicate with the secondary air supply duct 16, and the tertiary air holes d–h communicate with the tertiary air supply duct 17. The air supply duct 19, which is connected to a combustion fan 3, communicates with the tertiary air supply duct 17 and is also in communication with the primary and secondary air supply ducts 11, 16 via an air amount changeover unit 4.

The changeover unit 4 includes an air amount distribution chamber 20 for distributing air to the primary and secondary air supply ducts 11, 16, a slide valve 21 provided between the air amount distribution chamber 20 and the air supply duct 19, and a solenoid 22 for driving the slide valve 21. The center of the distribution chamber 20 is partitioned by a partitioning plate 23 having an orifice A. Orifices B and C are formed between the distribution chamber 20 and the air supply duct 19 on either side of the partitioning plate 23. The diameters of the orifices A, B and C are set in accordance with a prescribed amount of air supplied to the primary, secondary and tertiary air supply ducts 11, 16 and 17. An opening 25 is formed by the slide valve 21. The arrangement is such that when the solenoid 22 is in the deenergized state (i.e. off), the slide valve 21 is moved leftward in FIG. 9 by the resilient force of a spring 26, whereas when the solenoid 22 is in the energized state (i.e. on), the slide valve 21 is moved rightward in FIG. 9 against the force of the spring 26. In this embodiment, the amount of primary and secondary air on the small flow rate side is regulated by the orifice in the partitioning plate 23. However, it is permissible to provide this orifice in the slide valve 21 if desired.

The operation of the atomizer-equipped combustion apparatus of the invention having the foregoing construction will now be described with reference to FIG. 11. Since the combustion state is similar to that set forth above, a description thereof will be omitted.

IGNITION

Figure 11A:
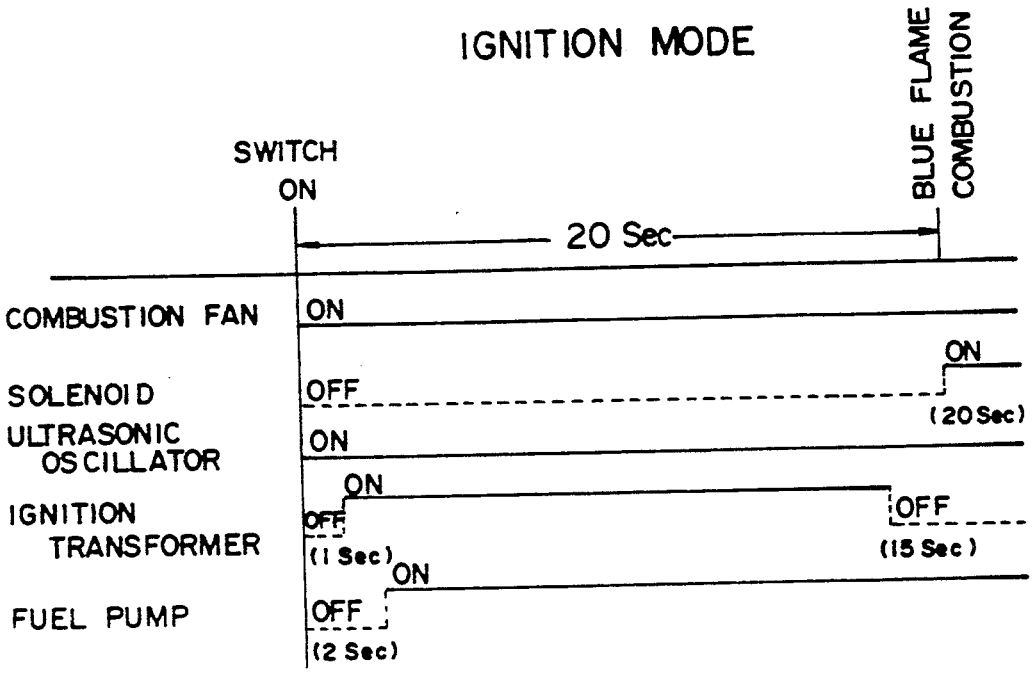
FIG. 11(*a*) and (*b*) shows timing charts for describing the operation of the embodiment of FIGS. 9 and 10.
Figure 11B:
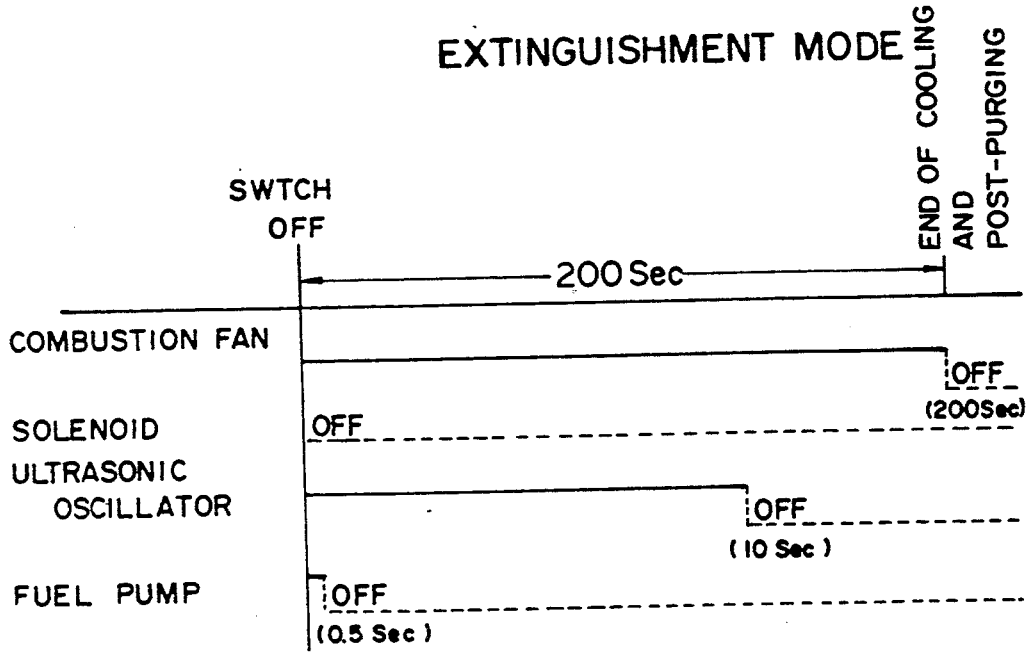

As shown in FIG. 11(*a*), the combustion fan 3 and the ultrasonic oscillator are turned on and the solenoid 22 is turned off when a main switch is closed (i.e. turned on). Next, an ignition transformer and fuel pump turn on in the order mentioned. Since the solenoid 22 is in the deenergized state, the slide valve 21 is situated on the left side in FIG. 9 so that the opening 25 and the orifice B are in communication. As a result, a major portion of the air introduced from the combustion fan 3 through the air supply duct 19 flows into the tertiary air supply duct 17, some of the remaining air flows into the secondary air supply duct 16 through the opening 25, orifice B and air distribution chamber 20, and a small amount of the air flows into the primary air supply duct 11 upon being restricted by the orifice A of distribution chamber 20. Though the amount of air which flows into the primary, secondary and tertiary air supply ducts should be in a proportion of 2:25:95 NL/min when considering a case in which the fuel is supplied at a rate of, say, 5 cc/min, it goes without saying that these numerical values can be changed appropriately depending upon a variety of conditions. It should be noted, however, that the flame will penetrate the interior of the spray chamber 1 and result in intermittent, unstable combustion if the amount of primary air is excessive, and that mist (white smoke) will be produced immediately after ignition if the amount of secondary air is inadequate. In addition, intermittent flashback is produced in the spray chamber if the preheating time is too short. As mentioned above, the time from the moment the preliminary mixture of fuel and primary air is first fed into the spray chamber 1 until the preliminary mixture within the spray chamber 1 attains thermal stability is on the order of 20 seconds. In this state the flame is a mixture of a blue and sparkling flames. Though odor at ignition of the apparatus is produced for several seconds after ignition, complete combustion is accomplished and odor vanishes when the reaction weight at the flame hole is large.

STEADY COMBUSTION

Figure 9:
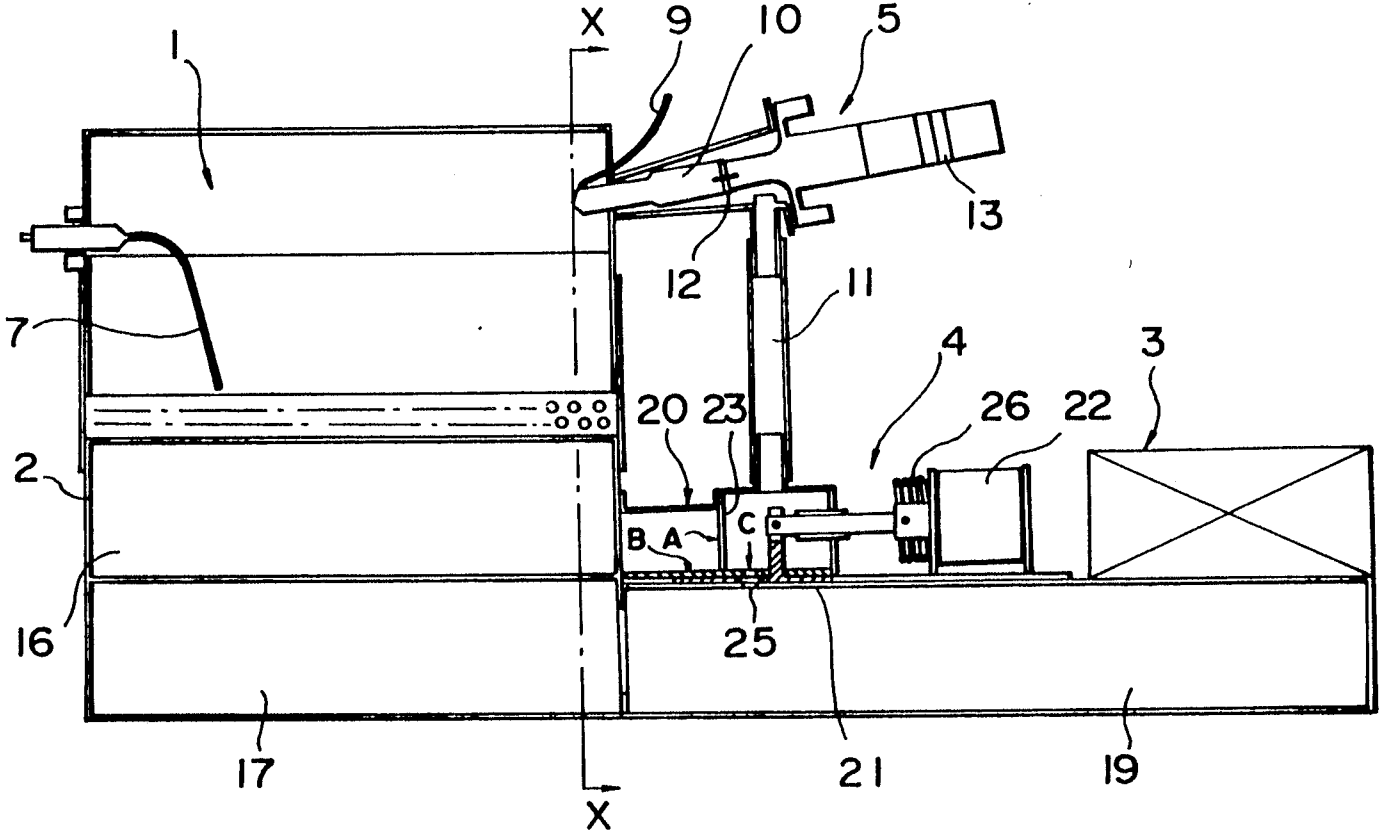
FIG. 9 is a sectional view illustrating a third embodiment of the present invention.
Figure 10:
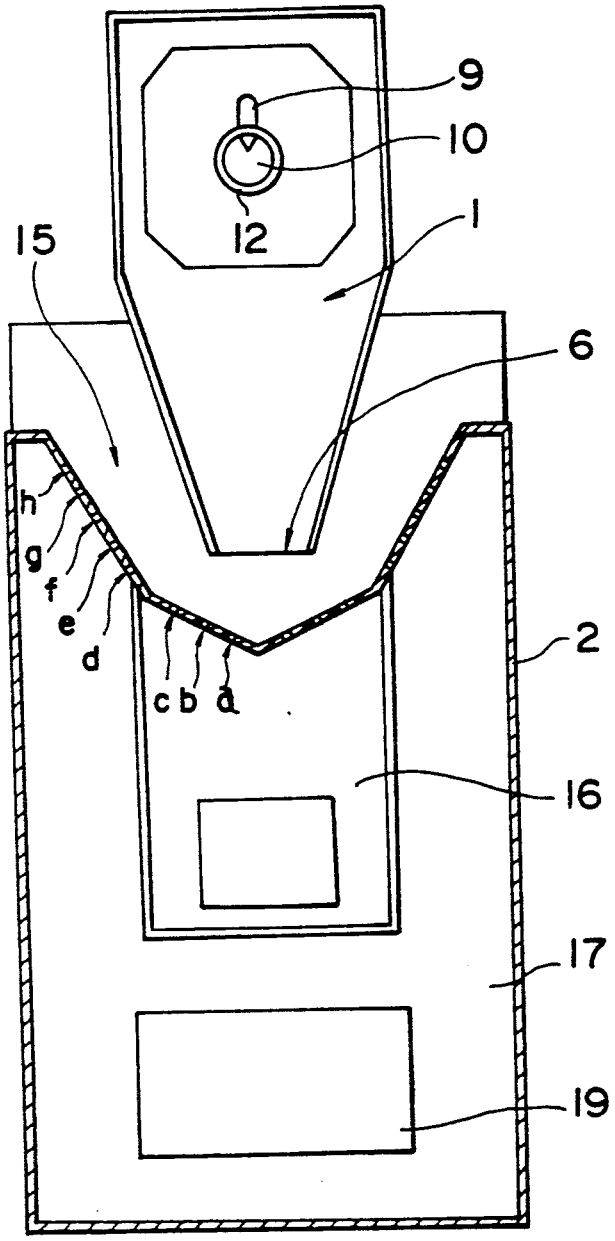
FIG. 10 is a sectional view taken along line X—X of FIG. 9.

When the solenoid 22 attains the on state, the slide valve 21 is moved rightward in FIG. 9 to bring the opening 25 and orifice C into communication. As a result, the major portion of the air introduced from the combustion fan 3 through the air supply duct 19 flows into the tertiary air supply duct 17, some of the remaining air flows into the primary air supply duct 11 through the opening 25, orifice C and air distribution chamber 20, and a small amount of the air flows into the secondary air supply duct 16 upon being restricted by the orifice a of the distribution chamber 20. Thus, in comparison with ignition, the amount of primary air is increased and the amount of secondary air is decreased.

Though the amount of primary air is increased and the amount of secondary air decreased at steady combustion in comparison with ignition, the amount of air which flows into the primary, secondary and tertiary air supply ducts should be in a proportion of 10:1.8:95 NL/min when considering a case in which the fuel is supplied at a rate of, say, 5 cc/min. However, it goes without saying that these numerical values can be changed appropriately depending upon a variety of conditions. It should be noted, however, that the flame will backflash into the interior of the spray chamber 1 if the amount of primary air is excessive, and that the blue flame will become somewhat unstable if the amount or primary air is inadequate. A red flame will mix in with the blue flame if the amount of secondary air is excessive, and the same will occur if the amount of tertiary air is inadequate.

EXTINGUISHMENT

As in the case of ignition, the solenoid 22 is placed in the off state to move the slide valve 21 leftward in FIG. 9, thereby bringing the opening 25 and the orifice B into communication, throttling the amount of primary air and increasing the amount of secondary air, after which the supply of fuel is cut off. Under these conditions, the secondary air penetrates into the interior of the spray chamber 1 and the unburned gas remaining in the spray chamber 1 is completely combusted. As a result, no odors are produced.

Figure 12:
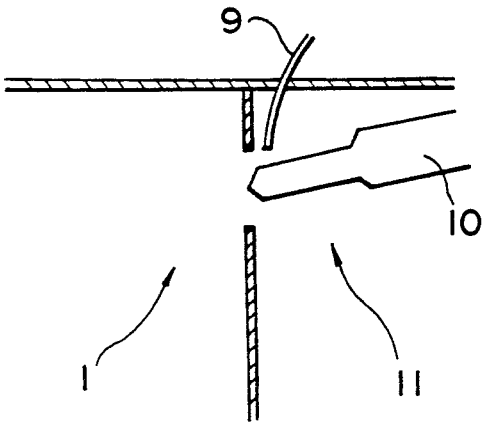
FIG. 12 is a sectional view showing an example of the arrangement of a oscillator horn.

FIG. 12 illustrates an example of another arrangement of the oscillator horn 10. In the embodiment of FIGS. 1 and 2, the fuel supply pipe 9 and oscillator horn 10 project into the spray chamber 1. Consequently, after the supply of fuel is halted at extinguishment of the flame, there are instances where the fuel remaining in the fuel supply pipe 9 is caused to evaporate for several seconds after fuel cut-off as a result of the fact that the temperature of the atmosphere in the spray chamber 1 is 400°–500° C. This can produce an odor. Furthermore, tar is produced on the side of the fuel supply pipe 9, leading to the possibility of pipe clogging or a change in flow rate if the apparatus is operated for an extended period of time.

Accordingly, in the arrangement shown in FIG. 12, the fuel supply pipe 9 and oscillator horn 10 are disposed on the side of the primary air supply duct outside the spray chamber 1, thereby reducing the influence of the temperature from the spray chamber 1 and effecting cooling by means of the primary air. As a consequence, the evaporation of the fuel remaining inside the fuel supply pipe 9 at the time of flame extinguishment is prevented, and the formation of tar within the fuel supply pipe 9 can also be prevented. Furthermore, a decline in durability caused by raising the temperature of the oscillator horn 10 is prevented as well as deterioration in the electroacoustic transducer 13 caused by the transmission of heat from the horn. In addition, thermal loss of ultrasonic oscillation increased by a rise in the temperature of the horn, as well as an increase in reactive power due to a current and voltage phase shift, can be suppressed. It is also possible to reduce the load on the high-frequency oscillator circuit.

A method of controlling the atomizer-equipped combustion apparatus of the invention will now be described in conjunction with FIGS. 13 through 16.

Figure 13:
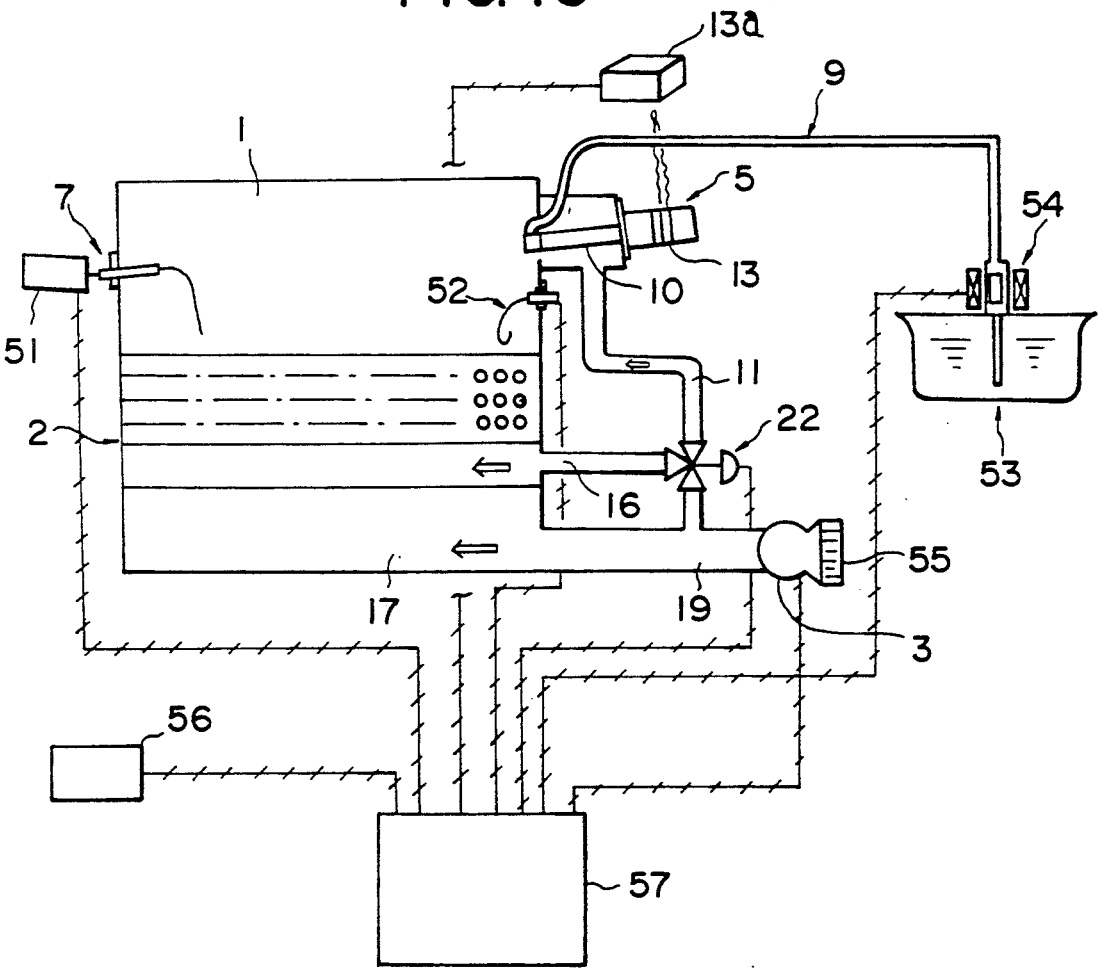
FIG. 13 is a view illustrating an embodiment of a system for controlling the atomizer-equipped combustion apparatus according to the invention.

FIG. 13 is a view showing the construction of combustion apparatus control system. Portions similar to those of the embodiment shown in FIG. 9 are designated by like reference characters and need not be described again. In FIG. 13, numeral 51 denotes an ignition transformer, 52 a flame sensor, 53 an oil pan, 54 a fuel pump, 55 an air filter, 56 a blower fan, and 57 a control unit.

This control system will now be described in further detail.

(a) Ignition

Figure 14:
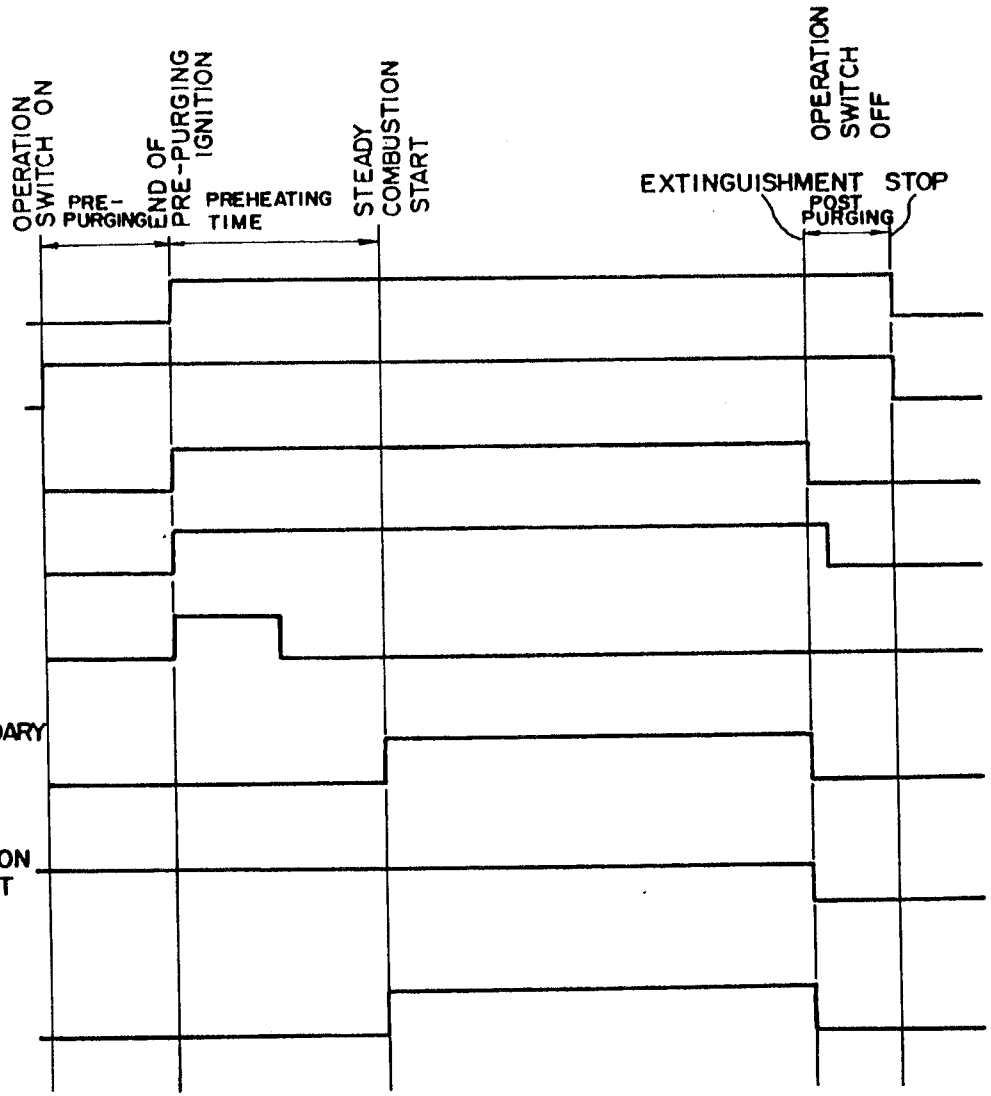
FIG. 14 is a view illustrating a timing chart for describing the operation of the present invention.

As shown in FIG. 14, an operation switch is turned on to start the motor of the combustion fan 3. Then, at the end of a pre-purging period of, say, ten seconds, the ultrasonic oscillator, blower motor, fuel pump and ignition transformer are turned on. The pre-purging time is necessary for cases where the apparatus is reignited immediately after being extinguished. Ordinarily, pre-purging is not strictly essential. Since the solenoid 22 of the primary-secondary air changeover unit is in the deenergized state at this time, a major portion of the air introduced from the combustion fan 3 through the air supply duct 19 flows into the tertiary air supply duct 17, some of the remaining air flows into the secondary air supply duct 16, and a small amount of the air flows into the primary air supply duct 11. At ignition, almost no primary air is required. Owing to diffusion of the spray, 1–2% of the total amount of air for combustion is introduced. Combustion is started and promoted by the secondary air which, if too much or too little in amount, causes a deterioration in ignitability. The optimum range of flow rates for the secondary air is 20–30% of the total amount of air for combustion, and that for the tertiary air is 70–80% of the total amount of air for combustion.

Under these conditions, the ultrasonic atomizing device 5 is driven into operation by the oscillator 13*a* and fuel starts being supplied from the fuel pump 54 to the atomizing region at the distal end of the oscillator horn 10 through the fuel supply pipe 9. When this is done, the fuel is atomized and sprayed into the spray chamber 1 together with a small amount of air flowing in from the primary air supply duct 11.

(b) Steady combustion

At the end of the prescribed preheating time, the solenoid 22 is energized As a result, the major portion of the air introduced from the combustion fan 3 through the air supply duct 19 flows into the tertiary air supply duct 17, some of the remaining air flows into the primary air supply duct 11, and a small amount of the air flows into the secondary air supply duct 16. Thus, in comparison with ignition, the amount of primary air is increased and the amount of secondary air is decreased.

Figure 15:
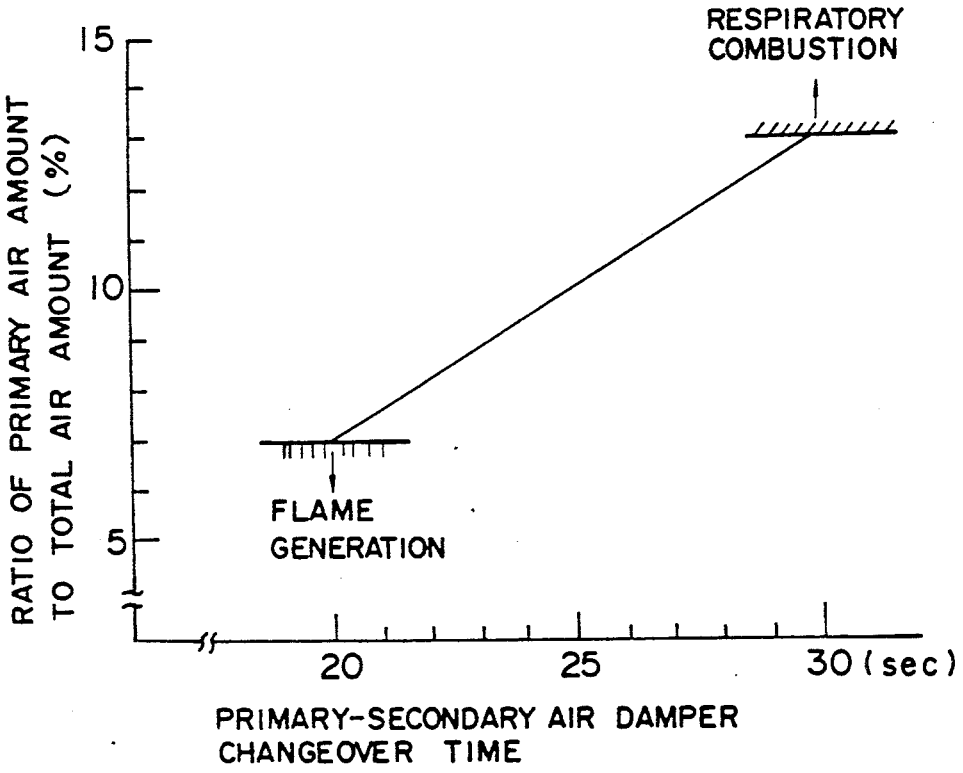
FIG. 15 is a view illustrating the relationship between primary-secondary air damper changeover time and the ratio of the amount of primary air to the total amount of air.

In this steady combustion state, the state of the flame is stable, as sensed by the flame sensor 52. Accordingly, the ventilation level is set and ventilation checking starts. The relationship between the ratio of the amount of primary air to the total amount of air at steady combustion and the primary-secondary air changeover time is as shown in FIG. 15. It is preferred that a suitable changeover time be selected in dependence upon the amount of primary air.

(c) Extinguishment

The operation switch is turned off to restore the solenoid 22 to the deenergized state, thereby throttling the amount of primary air and increasing the amount of secondary air, after which the supply of fuel is stopped. Under these conditions, the secondary air penetrates the interior of the spray chamber 1 and the unburned gas remaining in the spray chamber 1 is completed combusted. As a result, odors are no longer produced. It should be noted that since the ultrasonic atomizing device is effective in promoting combustion, it continues to be driven for a predetermined period of time, e.g., 10 seconds. Post-purging is carried out for a predetermined period of time, after which the blower motor 56 and the motor of the combustion fan 3 are turned off and stopped.

Figure 16:
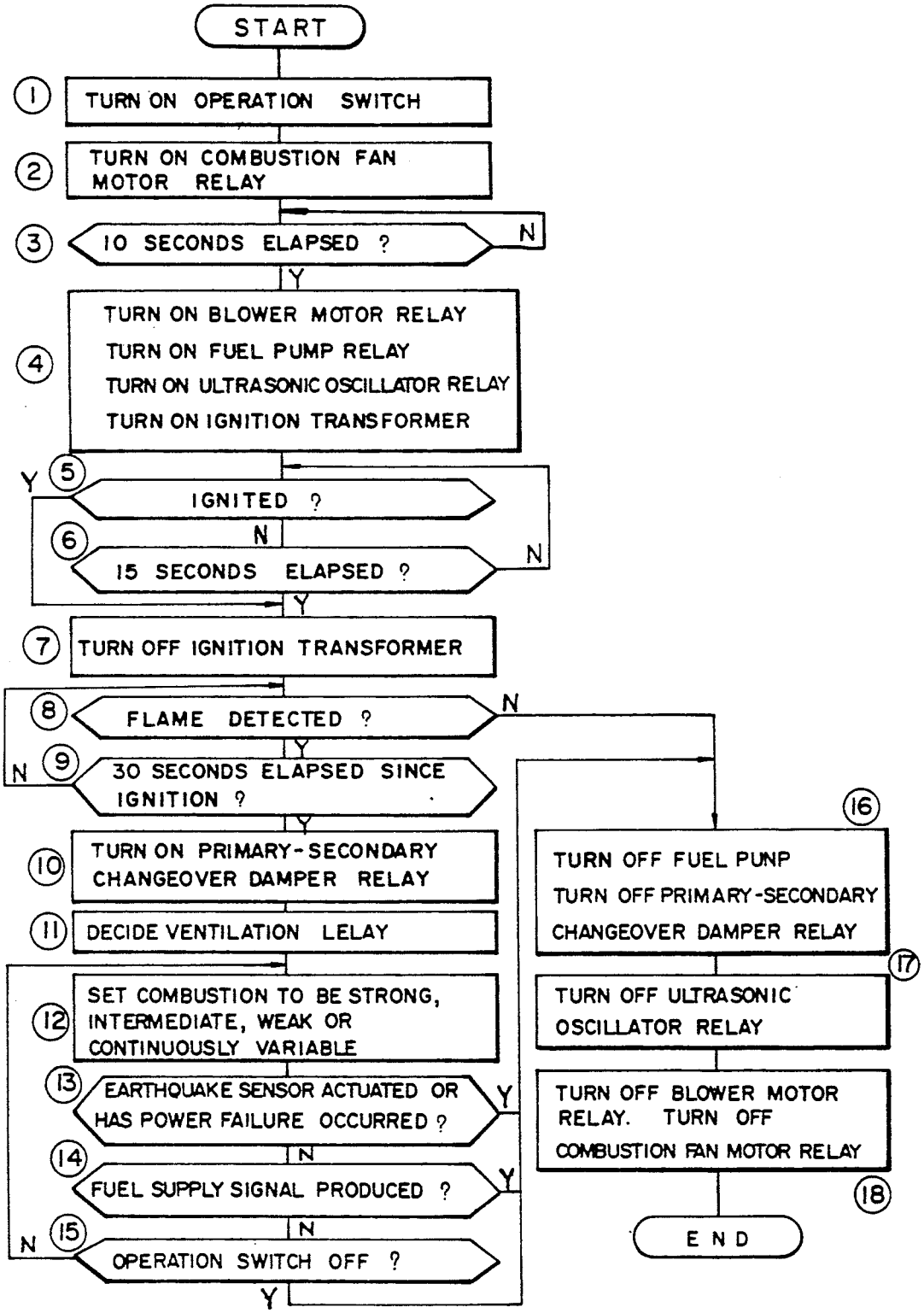
FIG. 16 is a flowchart for describing control flow in accordance with the invention.

Control flow in accordance with the present invention will now be described with reference to FIG. 16.

First, the operation switch is closed to turn on the relay of the combustion fan motor (steps 1 and 2). Upon elapse of the pre-purging time of, e.g., 10 seconds, a blower fan relay, fuel pump relay, ultrasonic oscillator relay and ignition transformer are turned on (steps 3 and 4). If ignition is achieved, the ignition transformer is turned off (steps 5 and 7). If ignition is not achieved, the ignition transformer is turned off upon elapse of 15 seconds (steps 6 and 7). When the flame is detected, a primary-secondary air changeover damper relay is turned on upon passage of a preheating time of 30 seconds, thereby changing over the ratio of primary air to secondary air (steps 8–10). When the steady combustion state is attained, the ventilation level is set and ventilation is checked (step 11), after which combustion is continued by continuously controlling the amount of combustion (step 12). Combustion continues as long as an earthquake detector does not operate, a power failure does not occur, fuel is supplied and the operation switch is not opened (i.e. as long as NO answers are received at steps 13, 14 and 15). If a flame is not detected (NO at step 8) or if a YES answer is received at any of the states 13, 14 and 15 regarding operation of the earthquake sensor, a power failure, supply of fuel and the status of the operation switch, the fuel pump relay and the primary-secondary changeover damper relay are turned off, the ultrasonic oscillator relay is turned off after a predetermined period of time, and the blower fan relay and combustion motor relay are turned off after post-purging, thereby halting combustion (steps 16, 17 and 18).

In the above-described embodiment, the changeover between the amounts of primary and secondary air is carried out a predetermined period of time after ignition. However, it is possible to adopt an arrangement in which the changeover is performed when the temperature of the spray chamber rises above a predetermined value, or in which the changeover is carried out in stages rather than in just a single switching operation. An arrangement is also possible in which a three-way valve, bimetal or the like is adopted to effect the changeover in the amounts of air instead of relying upon the solenoid to drive the slide valve.

The arrangement of the tertiary air holes, which is also a characterizing feature of the present invention, will now be described with reference to FIGS. 17 and 18.

Figure 17A:
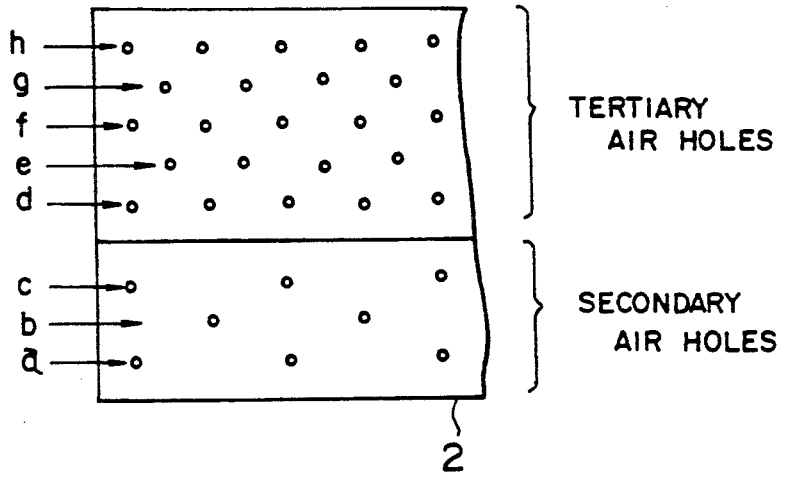
FIG. 17(*a*) is a plan view illustrating an arrangement of air supply holes, and FIG. 17(*b*) is a view for describing a problem associated with this arrangement.
Figure 17B:
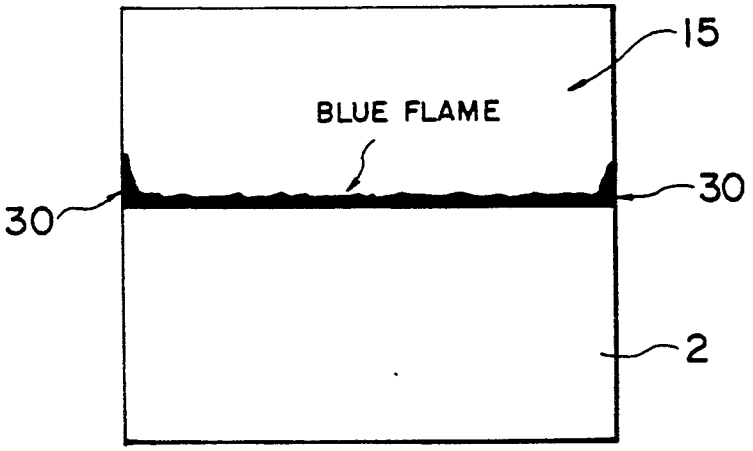

FIG. 17(*a*) illustrates the arrangement of secondary air holes a–c and tertiary air holes d–h formed in the upper surface of the wind box 2. The three rows of secondary air holes a–c are arranged in staggered fashion, as are the five rows of tertiary air holes d–h. With this arrangement, however, the amount of air supplied from the tertiary air holes at both ends of the wind box 2 is inadequate, and reaction is delayed due to cooling of the flame by the outer walls at both ends of the wind box. As a consequence, flames 30 at the end portions of the fire hole grow in length and a red flame is produced. This is undesirable.

Figure 18:
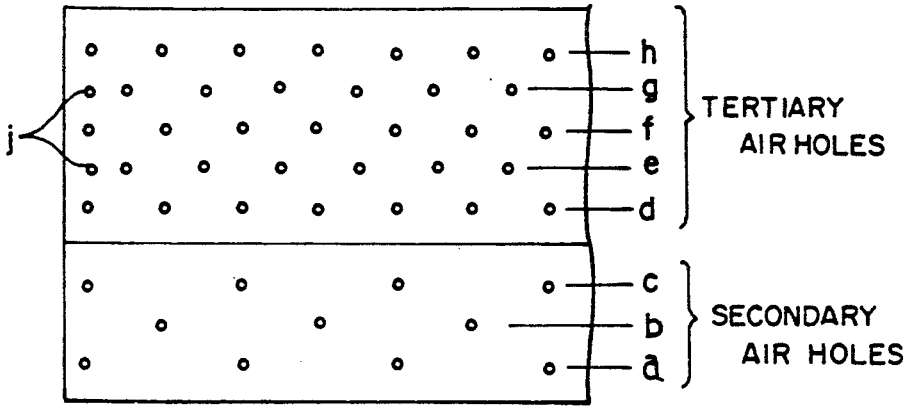
FIG. 18 is a plan view illustrating an arrangement of air supply holes in accordance with the present invention.

As a result of many experiments, it has become clear that a blue flame uniform in the longitudinal direction will be obtained if the tertiary air holes are arranged as shown in FIG. 18. Specifically, those rows of the tertiary air holes d–h that do not include an air hole at the end portion of the wind box 2 are provided with additional air holes j, j to promote the combustion at the end portion of the wind box 2.

Figure 19:
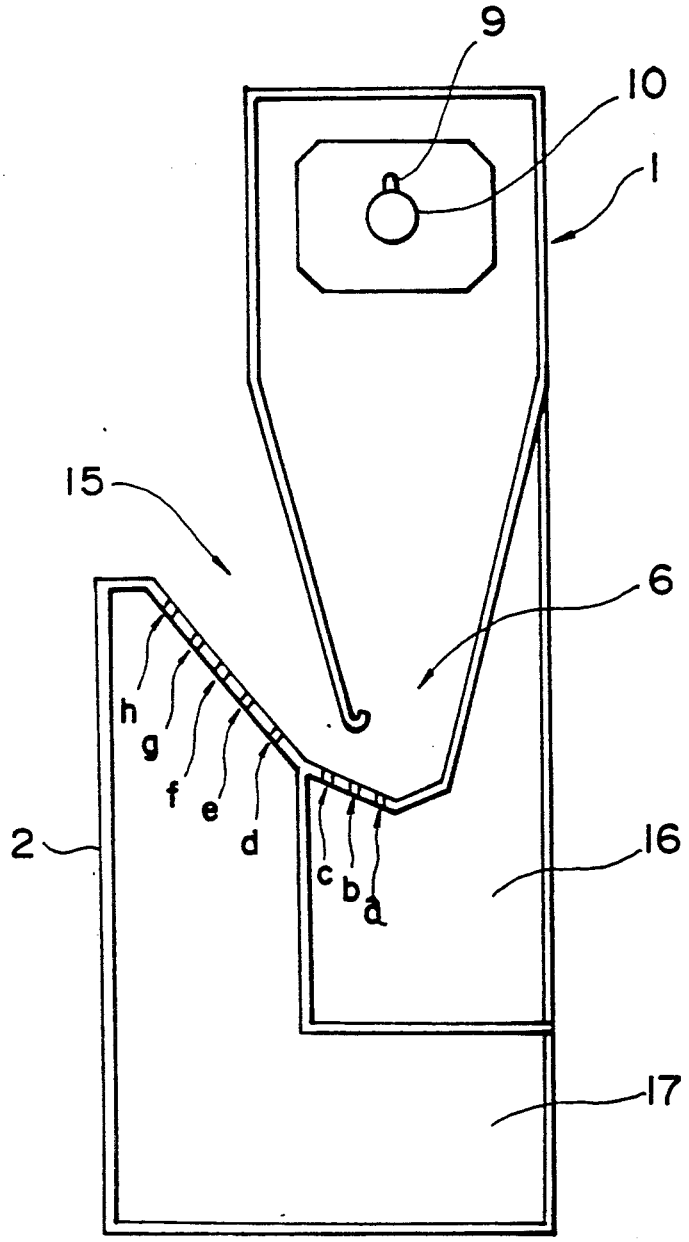
FIG. 19 is a sectional view a further embodiment of the present invention.

FIG. 19 illustrates a further embodiment of the spray chamber 1 and wind box 2. Here the wind box 2 is formed in such a manner that its upper portion is inclined toward one side from the opening 6 of the spray chamber 1, with the combustion space 15 being formed between the upper surface of the air box 2 and the spray chamber 1. In a case where this embodiment is applied to the so-called line-type combustor the entirety of which generally has the shape of a rectangular parallelepiped, the embodiment greatly contributes to forming a more slender apparatus. Since the combustion space 15 is located on one side, the structure is simplified and the overall apparatus is made more slender in comparison with the arrangement in which the combustion space is on both sides. In addition, this embodiment makes it possible to view the entire flame so that heating can be adjusted upon visually confirming the state of the flame. This has advantages in terms of safety as well. The blowing of air for combustion is also facilitated.

Figure 20:
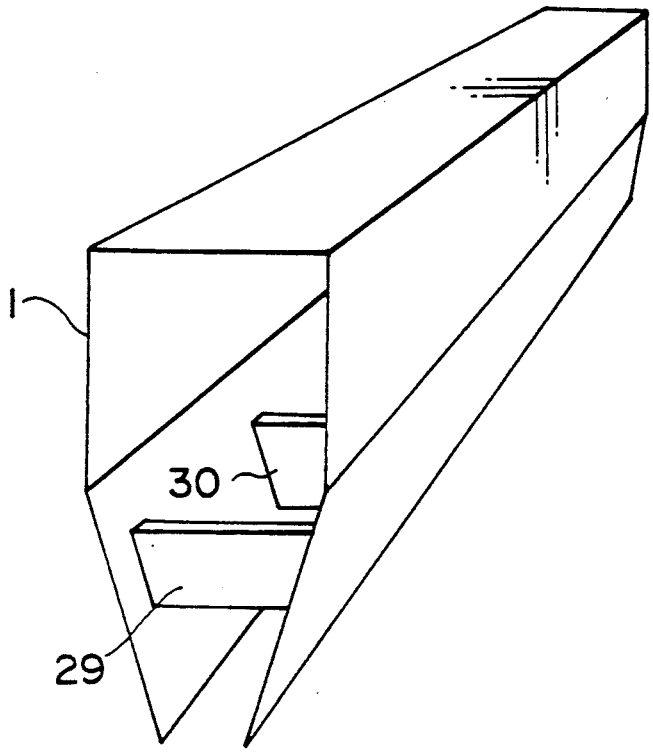
FIGS. 20 and 21 are views illustrating modifications of the spray chamber.

FIG. 20 is a perspective view showing a modification of the spray chamber 1. In this case the interior of the spray chamber 1 is provided with a plurality of heat transfer fins 30 by which the temperature rise inside the spray chamber 1 at ignition and extinguishment can be hastened.

Figure 21:
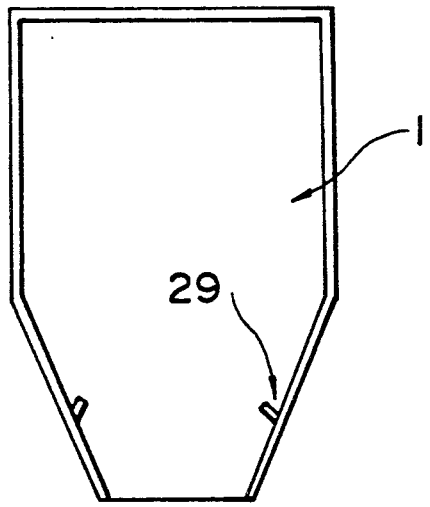

FIG. 21 is a sectional view illustrating another modification of the spray chamber 1. The end portion of the spray chamber 1 that forms the flame hole is formed to have a groove 29, which is a characterizing feature of the invention. It is also possible to adopt an arrangement in which the groove 29 is formed in the intermediate portion of the slanted side wall surface of the spray chamber 1. Some of the droplets that are sprayed in the spray chamber 1 attach themselves to the inner wall surface and join other droplets, and the droplets which flow out along the inner wall surface collect in the grooves 29. Thus, the grooves 29 make it possible to prevent ignition delay and the production of odors at low temperatures (e.g. below freezing), and a stabilized initial combustion state can be obtained. Furthermore, since there is greater allowance for the droplets to cling to the wall surfaces than in the conventional configuration, the vaporization chamber can be reduced in size so that the overall apparatus can be made more compact.

Figure 22:
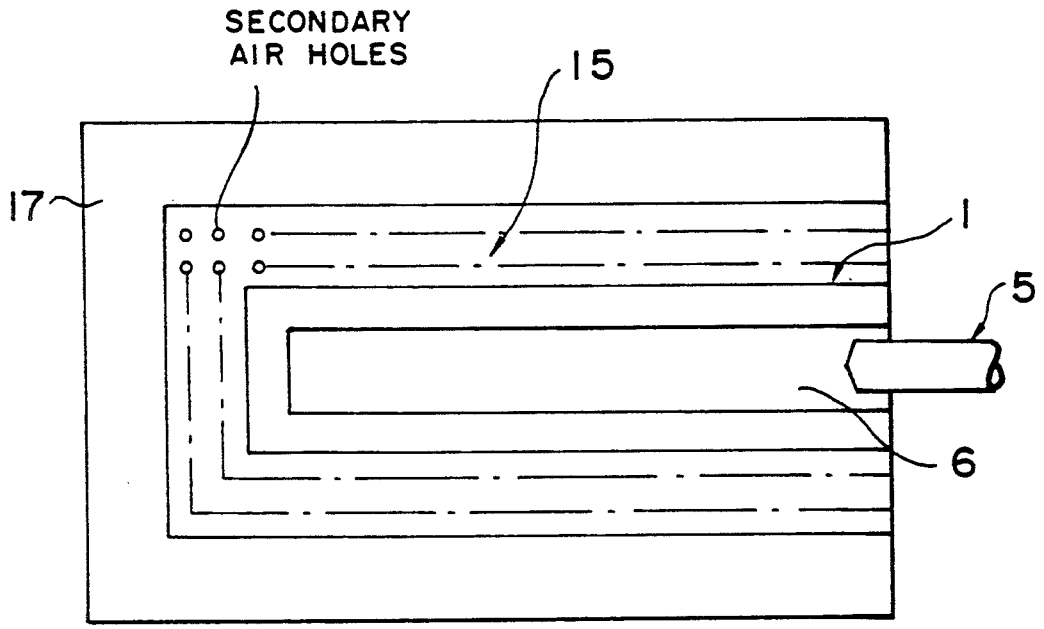
FIG. 22 is a view illustrating a modification of a combustion space.

FIG. 22 illustrates an embodiment of the combustion space. In the line-type combustion apparatus, the spray chamber 1 is substantially a rectangular parallelepiped in shape, and the combustion space 15 is formed also on the outer side of the side wall opposing the side wall of the spray chamber 1 that is provided with the ultrasonic atomizing device 5. It should be noted that the shape of the spray chamber 1 is not limited to a rectangular parallelepiped, and a portion of the side wall can be formed as a curved surface.

Figure 23:
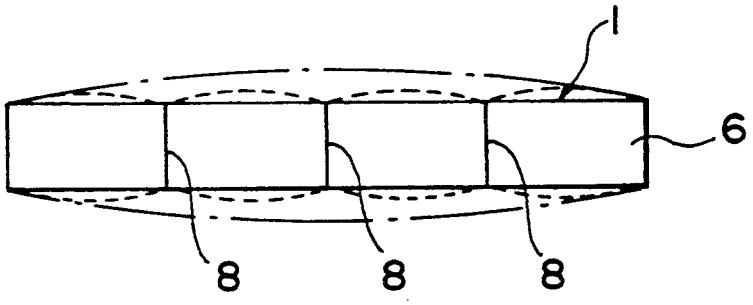
FIGS. 23, 24 and 25 are plan views illustrating modifications of the spray chamber.

FIG. 23 shows an embodiment of the spray chamber 1, which is a characterizing feature of the present invention. Here a plurality of beams or pins 8 connecting the side walls sandwiching the opening 6 are provided in the vicinity of the opening 6 of the spray chamber 1 which receives most of the influence of the combustion heat. By providing these beams or pins 8, deformation of the side walls can be strongly suppressed.

Figure 24:
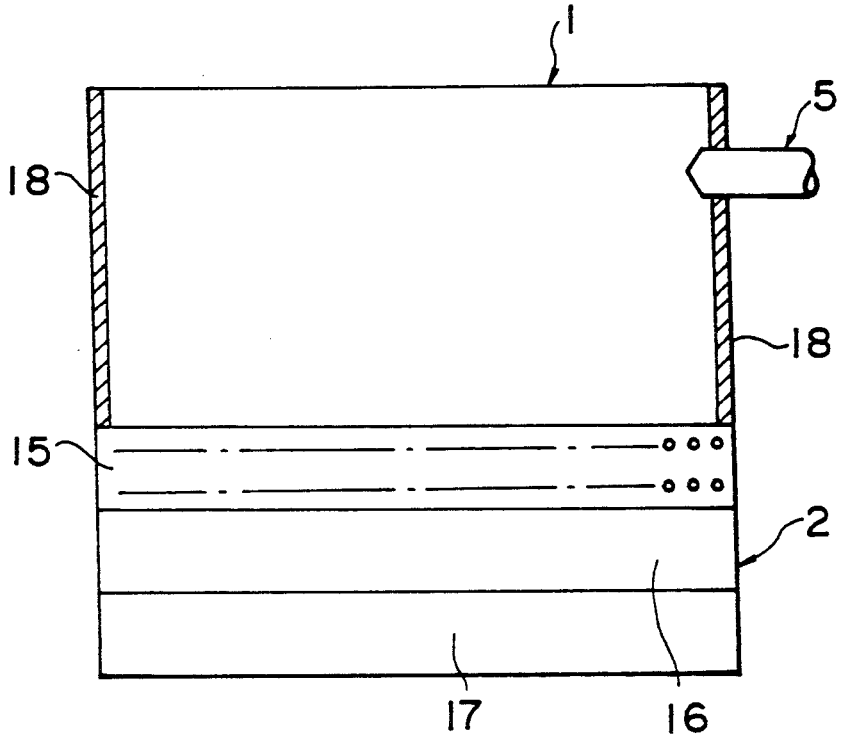

FIG. 24 illustrates another modification of the spray chamber 1, in which a freely expandable heat insulator 18 is interposed between the outer wall of the combustion apparatus and both side end portions of the side wall of the spray chamber 1. For example, ceramic fibers or the like can be used as the heat insulator 18 which serves to absorb thermal expansion of the side wall of the spray chamber 1.

Figure 25:
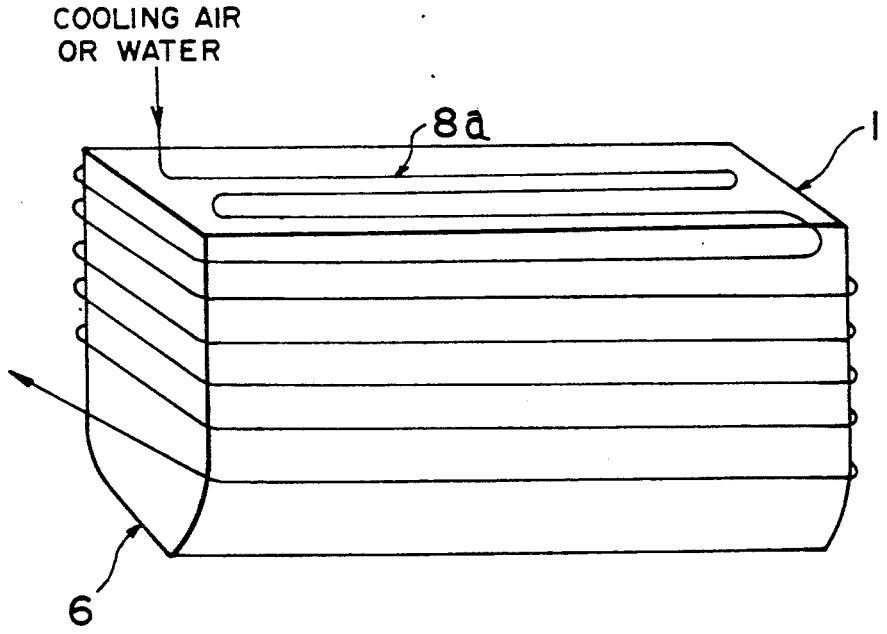

FIG. 25 shows another modification of the spray chamber 1, in which the chamber 1 is surrounded by a tube 8*a* through which cooling air or water is circulated. Since the cooling air or water is heated by the heat of combustion, it is possible to thermally recover the same at utilize it as heating air or heating water. It is permissible to provide the tube within the inner wall of the spray chamber 1. An arrangement is also possible in which the inner wall or outer wall of the spray chamber 1 is surrounded by a jacket containing water.

Figure 26:
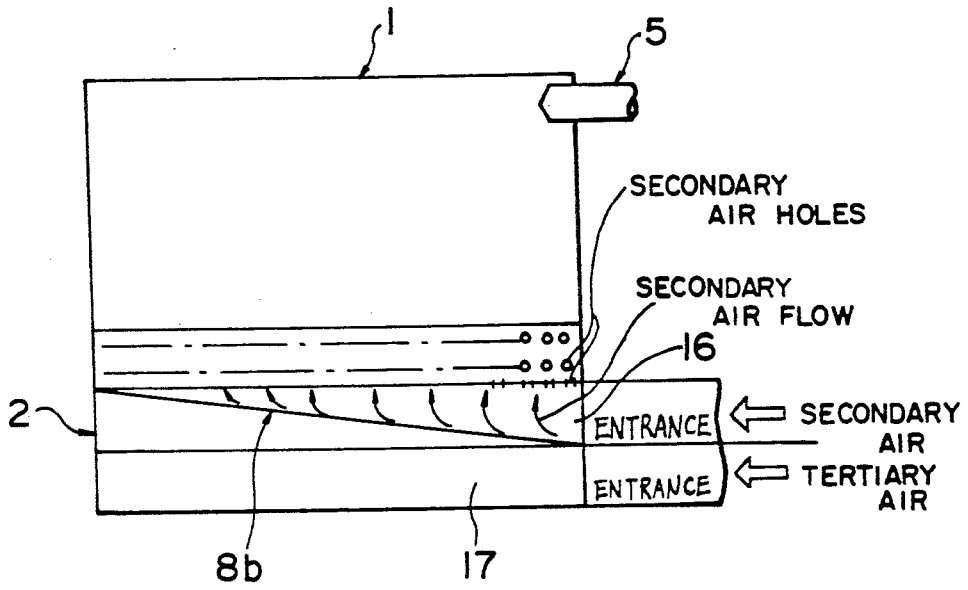
FIGS. 26 and 27 are sectional views illustrating a modification of a secondary air supply duct.

FIG. 26 depicts a modification of the secondary air cooling duct. Here a baffle 8*a* is disposed within the secondary air supply duct 16 and slants upwardly from the upstream side to the downstream side so as to reduce the sectional area of the air passageway. If the baffle plate 8*a* is not provided, unburned gas may in some cases flow backwardly in the secondary air supply duct 16 and produce tar, since the amount of secondary air from the secondary air holes at steady combustion is very small (1–2%), as mentioned earlier. When the apparatus cools, as at the end of the combustion operation, the tar deposits on the secondary air supply duct and is a cause of odors. However, if the baffle 8*b* is provided as in this modification, the air is expelled from the secondary air holes in a uniform manner and the pressure within the secondary air supply duct 16 is made positive, thereby preventing backward flow of unburned gases within the secondary air supply duct 16.

Figure 27:
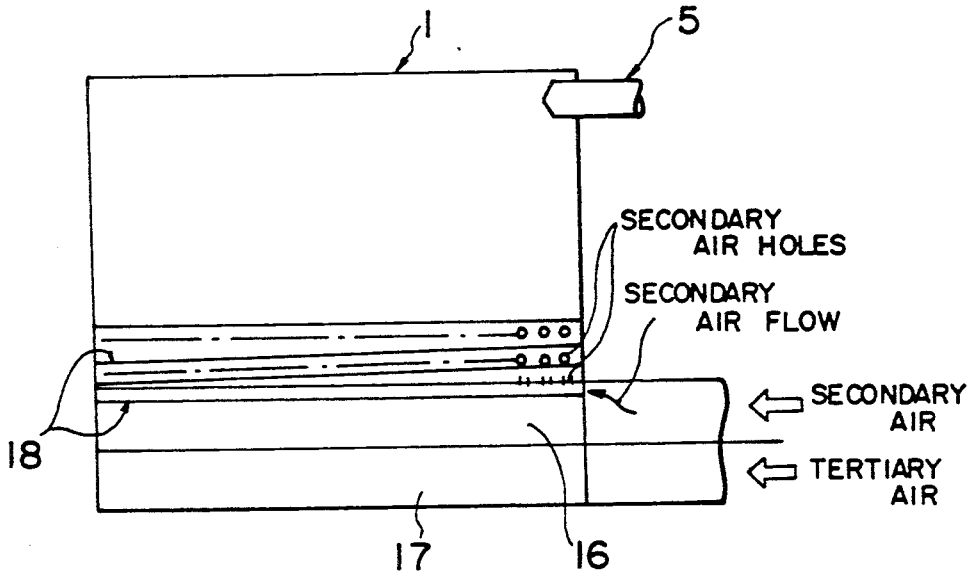

FIG. 27 shows another modification of the secondary air supply duct, in which the duct 16 is composed of a plurality of tubes 18 each of which is formed to have secondary air holes. The effects obtained are similar to those described in connection with FIG. 15.

Figure 28:
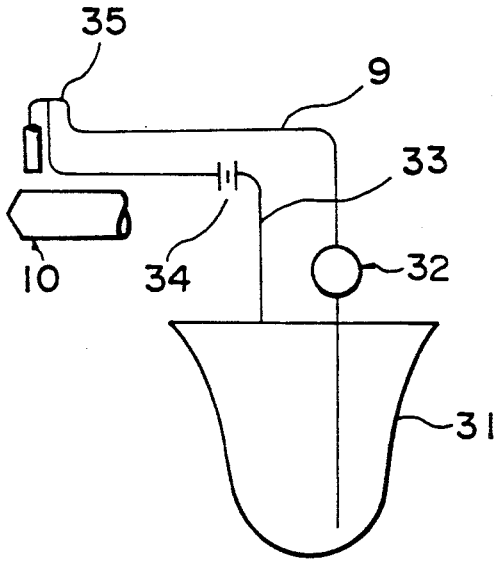
FIG. 28 is a schematic view of a fuel supply system.

FIG. 28 shows a schematic view of a fuel supply system. Fuel from a fuel tank 31 is delivered to the oscillator horn 10 via the fuel supply pipe 9 by an electromagnetic pump 32 for fuel supply. The end of the fuel supply pipe 9 which opens to the oscillator horn 10 is formed into a generally inverted U-shaped portion 35. One end of a return pipe 33 is connected to the inverted U-shaped portion 35, and the other end of the return pipe opens to the fuel tank 31 through an orifice 34.

The fuel from the fuel tank 31 is dropped onto the oscillator horn 10 through the fuel supply pipe 9 by the action of the pump 32, and the drops of fuel are atomized by the horn 10. When combustion stops, the pump 32 also halts the supply of fuel. However, since the interior of the spray chamber 1 is pressurized by the blower pressure, there is a head effect which causes the fuel at the distal end portion of the fuel supply pipe 9 to be returned to the interior of the fuel tank 1 through the return pipe 33. By providing the orifice 34, the short-circuited circulation of fuel to the fuel tank 31 at combustion is held to the minimum.

In the above-described embodiment, the inverted U-shaped portion 35 is formed in the fuel supply pipe 9 at the point where the return pipe 33 branches off. However, the invention is not limited to this embodiment, for a branch portion can be formed at the end of the fuel supply pipe 9 and the return pipe 33 can be connected thereto. Since the fuel returned to the fuel tank 31 travels from the end of the fuel supply pipe 9 to this branch portion, less time will be required to supply fuel for initiating combustion next time, thus making it possible to perform ignition earlier.

Various configurations of the spray chamber 1 will now be described with reference to FIGS. 29 through 34.

Figure 29:
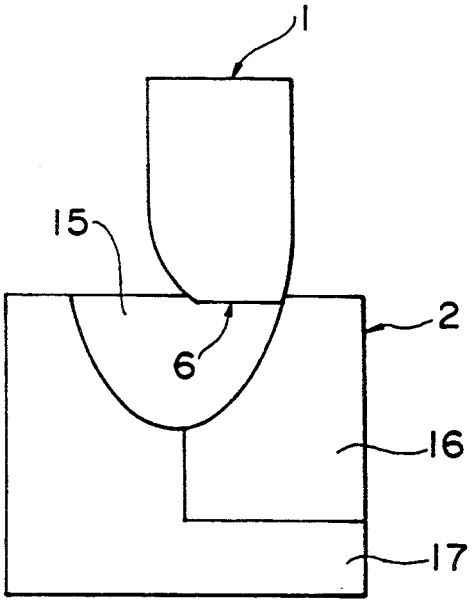
FIGS. 29 through 34 are views illustrating various configurations of the spray chamber.

In the embodiment of FIG. 29, the side wall of the spray chamber in the vicinity of the opening 6 is formed to have an inwardly curved configuration, and one wall of the spray chamber 1 and the surface of the air box 2 having the air supply holes are formed so as to be connected. The curved surface of the upper portion of air box 2 has the secondary air supply duct 16 connected to one side thereof and the tertiary air supply duct 17 connected to the other side thereof. This provides a more compact apparatus in comparison with the embodiment of FIG. 2.

Figure 30:
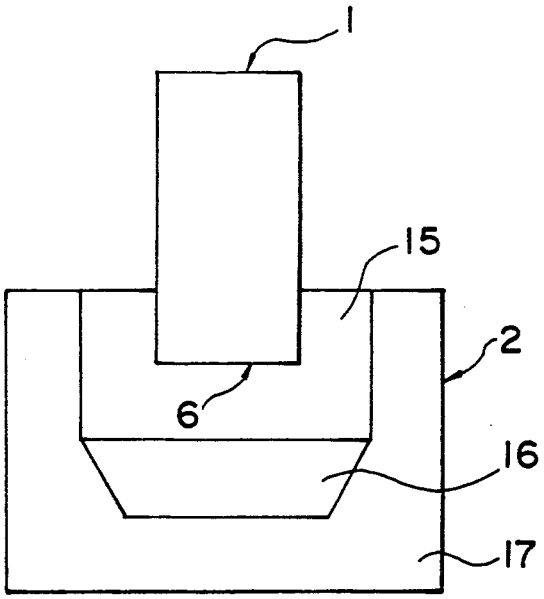

In the embodiment of FIG. 30, the side wall of the spray chamber 1 in the vicinity of the opening 6 is not curved inwardly but is formed to vertical instead. The opposing face which supplies the air from the tertiary supply duct 17 is formed to be vertical, and the face which supplies the air from the secondary supply duct 16 is formed to be horizontal.

Figure 31:
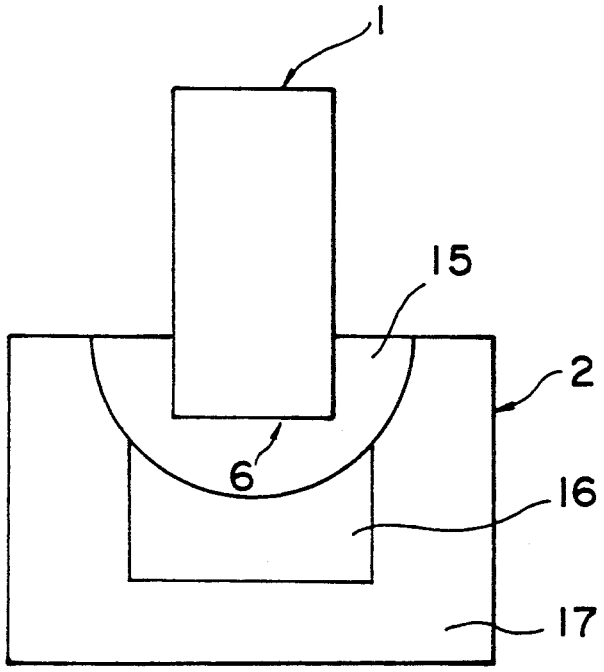

The embodiment of FIG. 31 is similar to that of FIG. 30 in that the side wall of the spray chamber 1 in the vicinity of the opening 6 is not curved inwardly. In this embodiment, however, the surface of the air box 2 having the air supply holes is given a curved configuration similar to that of the embodiment shown in FIG. 29.

Figure 32:
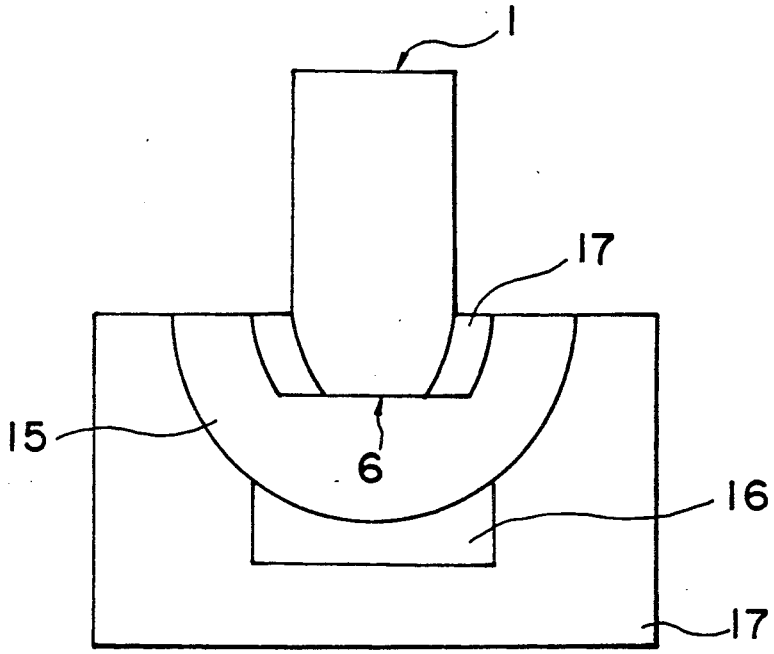

In the embodiment of FIG. 32, the tertiary air supply duct 17 is formed on the outer wall surface of the spray chamber 1 as well, and diffused mixing in the combustion space 15 takes place from both sides to further stabilize combustion.

Figure 33:
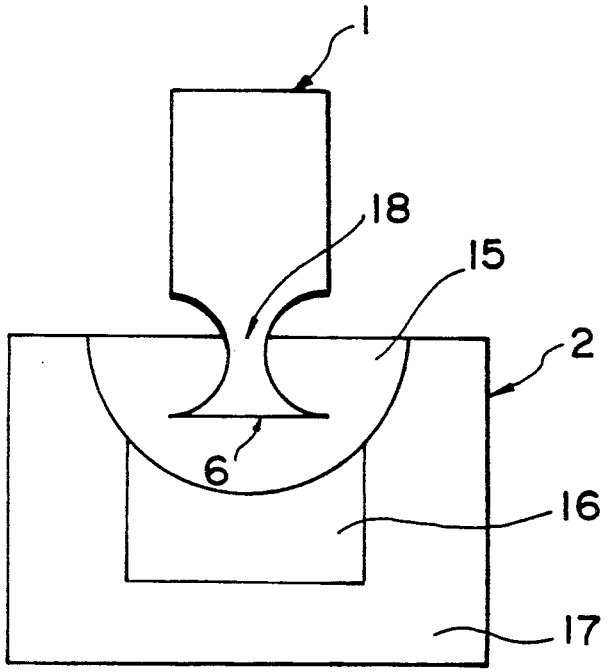

In the embodiment of FIG. 33, the lower portion of the spray chamber 1 is integrally formed to have a constricted portion 18. An arrangement can also be adopted in which the constricted portion 18 is formed by attaching a separate member. A heat insulator can also be used.

Figure 34:
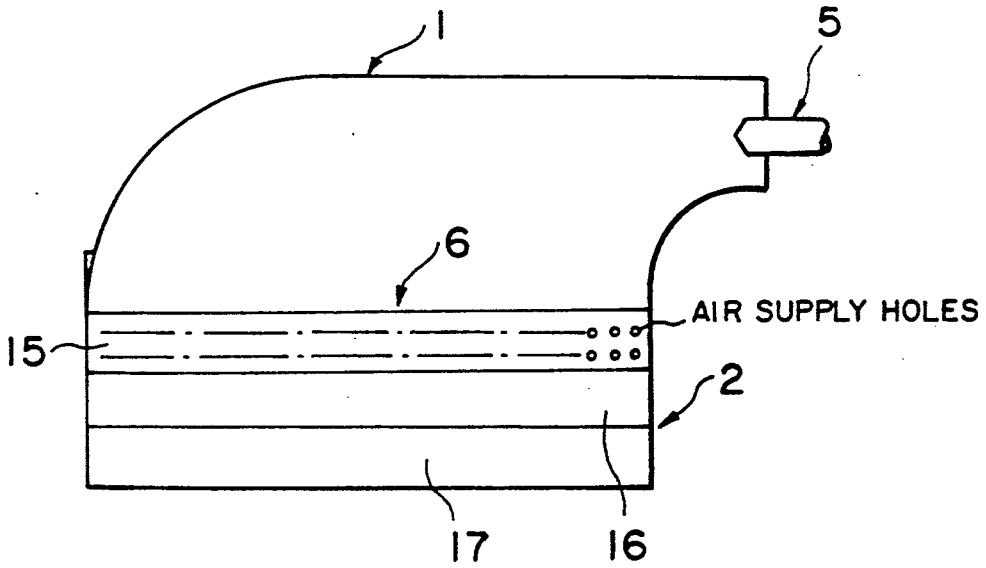

In the embodiment of FIG. 34, the ceiling surface of the spray chamber 1, a side wall provided with the atomizer 5 and a side wall opposing the first-mentioned side wall are formed to be curved surfaces to conform to the spray pattern. This makes it possible to obtain a more compact apparatus.

An embodiment provided with an auxiliary air supply duct will now be described with reference to FIGS. 35 through 42. Portions similar to those of the embodiment shown in FIGS. 9 and 10 are designated by like reference characters and need not be described again.

Figure 35:
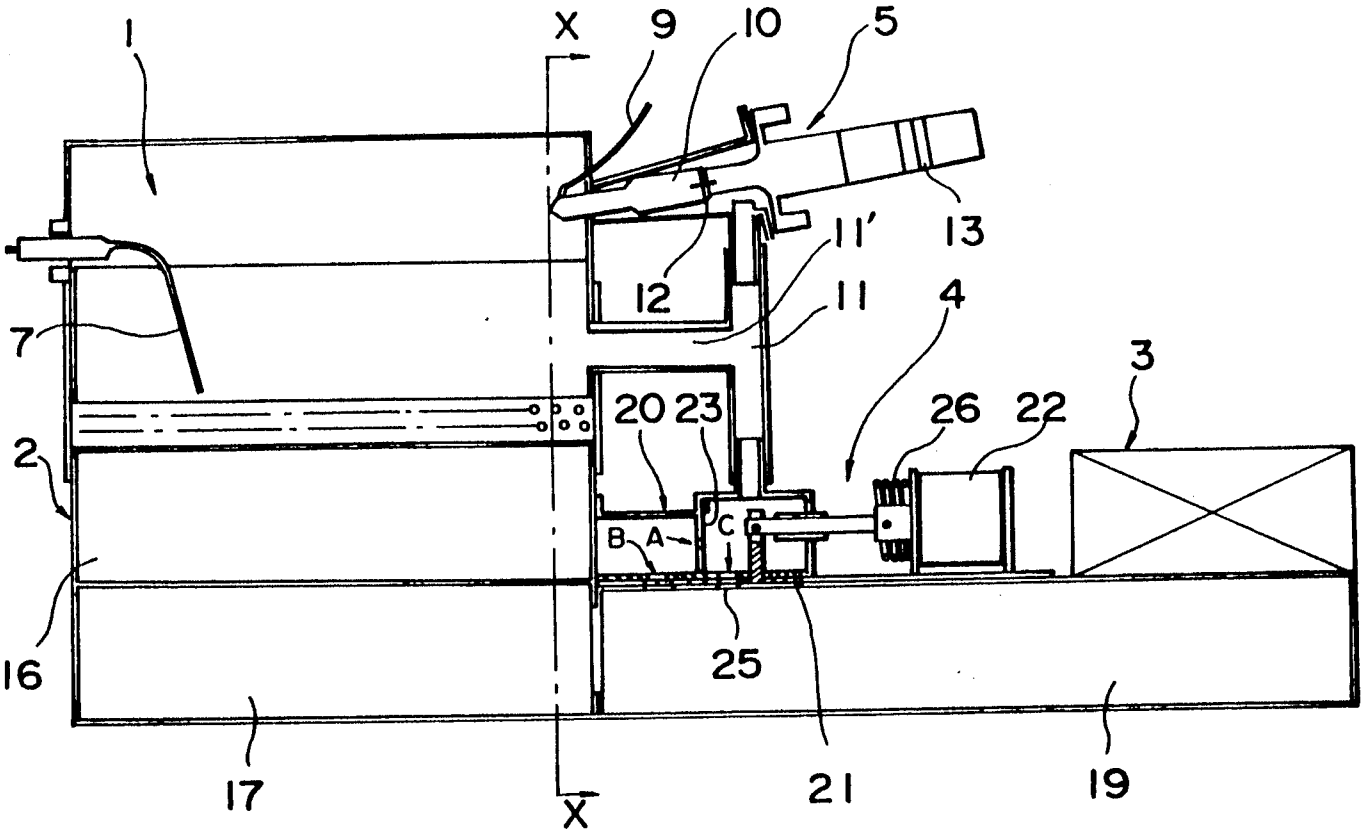
FIGS. 35 through 42(*a*) and (*b*) are views illustrating various configurations of a spray chamber having an auxiliary air supply duct.
Figure 36:
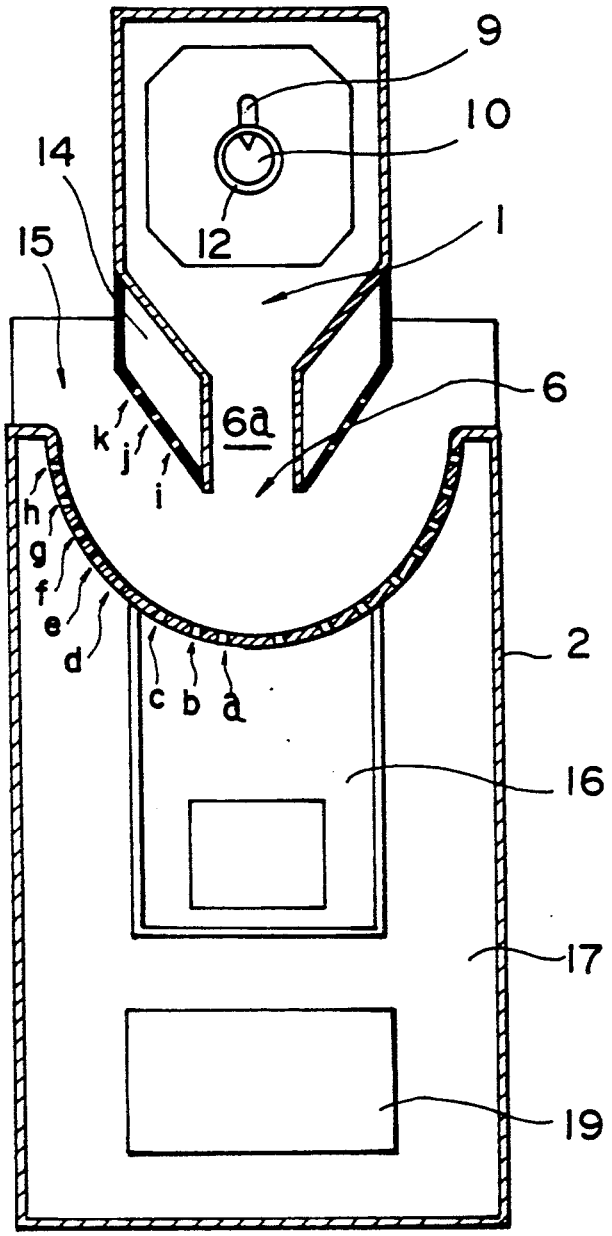

As shown in FIG. 36, the air box 2 is formed so that its upper portion defines a curved surface. The spray chamber 1 is formed to have a constricted portion **6*a* at its lower part, and the outer periphery of the constricted portion 6*a* is formed to have an auxiliary air supply duct 14 provided with air holes i, j, k opposing the air box 2. As shown in FIG. 35, it is arranged so that air from the primary air supply duct 11 is supplied to the auxiliary air supply duct 14 via a branch pipe 11'. Accordingly, since the outlet passageway of the spray chamber 1 is narrowed by the constricted portion 6*a*, the mixing of air and fuel is promoted and a more uniform flame distribution can be obtained. Furthermore, since air is discharged from the tertiary air holes d–f to oppose the auxiliary air holes i–k of the auxiliary air supply duct 14, the lower end portion of the spray chamber 1** is cooled to prevent the temperature thereof from rising and improve durability. In addition, since the elongation of the flames is suppressed at the positions of the air holes, it is possible to improve the exhaust gas characteristic when the amount of air is insufficient.

Though the flow rates of the primary, auxiliary, secondary and tertiary air should be in a proportion of 2:2:24:94 NL/min when considering a case in which the fuel is supplied at a rate of, say, 5 cc/min, it goes without saying that these numerical values can be changed appropriately depending upon a variety of conditions.

Figure 37:
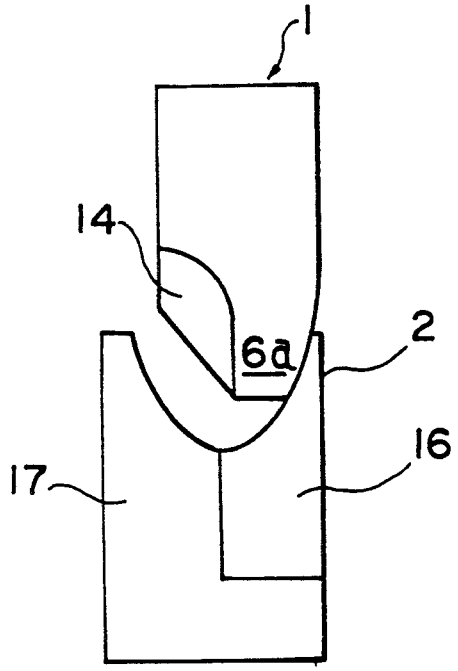

In the embodiment of FIG. 37, one side of the spray chamber 1 at the lower constricted portion **6*a* thereof is formed to have the auxiliary air supply duct 14, and the surface of the air box 2 having the air supply holes is formed so as to be connected with the wall opposing the duct 14. The curved surface of the upper portion of air box 2 has the secondary air supply duct 16 connected to one side thereof and the tertiary air supply duct 17 connected to the other side thereof. This provides a more compact apparatus in comparison with the embodiment of FIG. 36**.

Figure 38:
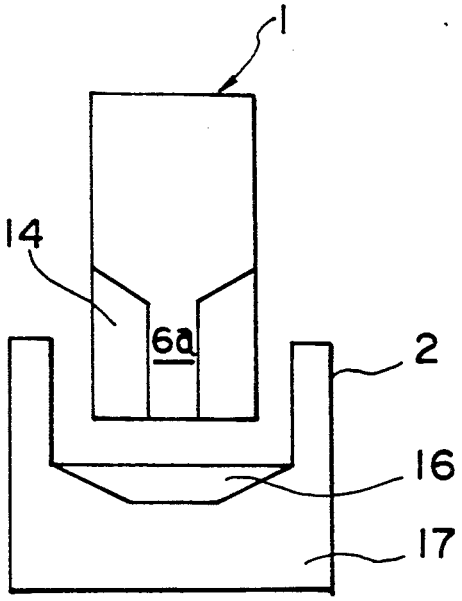

In the embodiment of FIG. 38, the side wall of the spray chamber 1 is formed to be vertical, the opposing face which supplies the air from the tertiary supply duct 17 is formed to be vertical, and the face which supplies the air from the secondary supply duct 16 is formed to be horizontal.

Figure 39:
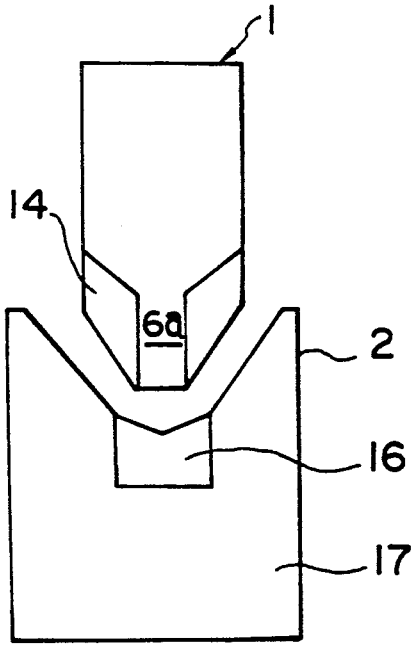

Whereas the air supply surfaces of the secondary and tertiary air supply ducts 16, 17 are curved surfaces in the embodiment of FIG. 36, in the embodiment of FIG. 39 the secondary and tertiary air supply surfaces are formed to be horizontal surfaces having different inclinations.

Figure 40:
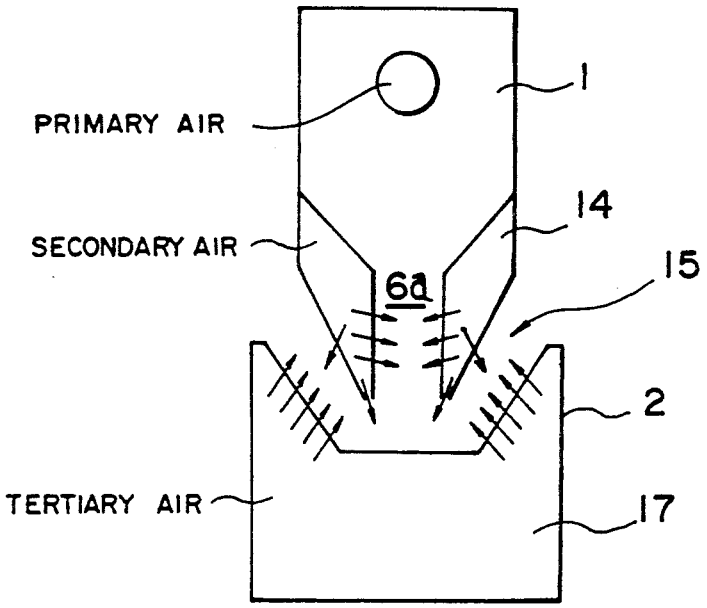

In the embodiment of FIG. 40, the arrangement is such that secondary air is supplied to the auxiliary air supply duct 14 and tertiary air only is supplied to the interior of the air box 2. By supplying secondary air to the constricted portion 6a of spray chamber 1 and to the combustion space 15, initial combustion takes place at the constricted portion. As a result, it is unnecessary to provide the secondary air supply duct inside the air box 2, thereby simplifying the structure and providing a more compact apparatus. Furthermore, discharging a small amount of air at steady combustion lowers the temperature of the spray chamber 2 and improves durability.

Figure 41:
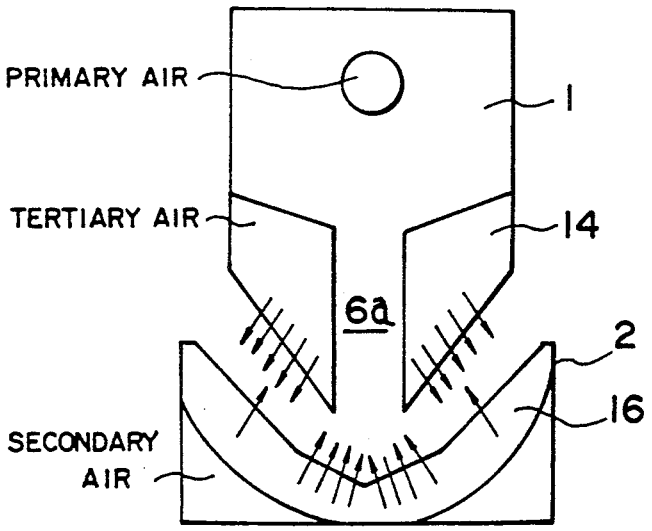

In the embodiment of FIG. 41, the arrangement is such that tertiary air is supplied to the auxiliary air supply duct 14 and secondary air only is supplied to the interior of the air box 2. As a result, it is unnecessary to provide the tertiary air supply duct inside the air box 2, thereby simplifying the structure and providing a more compact apparatus.

Figure 42A:
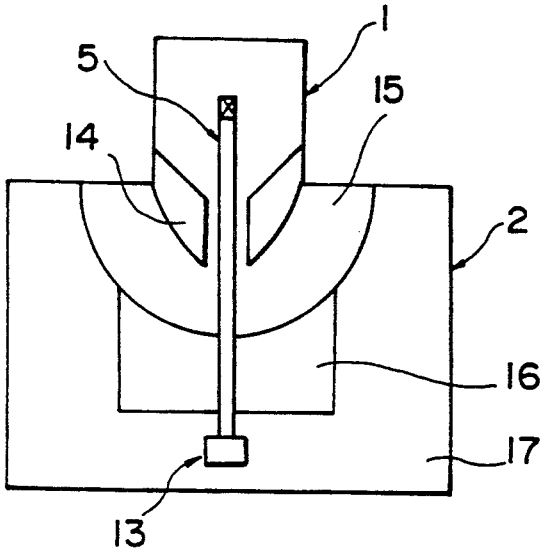
Figure 42B:
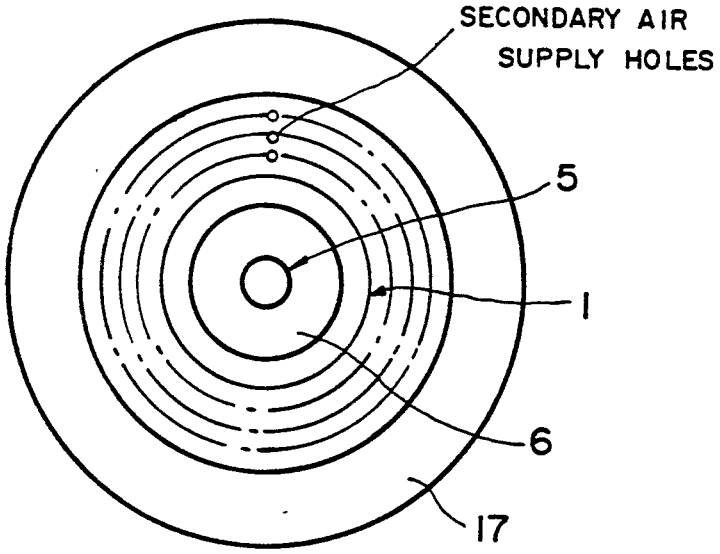

FIG. 42 illustrates an example in which the invention is applied to a cylindrical-type combustor, in which (a) is a sectional view and (b) a plan view. The spray chamber 1 is substantially cylindrical in shape, the periphery at the lower portion thereof is formed to have the auxiliary air supply duct 14, and the electroacoustic transducer 13 of the ultrasonic atomizer 5 is disposed inside the tertiary air supply duct 17. In other respects the structure is the same as that of the embodiment of FIG. 36. In this embodiment, however, size is reduced and the effect for cooling the electroacoustic transducer 13 is improved.

Though embodiments of the present invention have been described, the invention is not limited to these embodiments but can be modified in various ways.

For example, in the above-described embodiments, the atomizing device employed utilizes an ultrasonic oscillation. However, an arrangement can be adopted in which an atomized state is produced by, e.g., a pressure injection valve.

What is claimed is:

1. A method for controlling a combustion apparatus provided with an ultrasonic atomizing device including an ultrasonic atomizing device for supplying liquid fuel to an atomizing zone of an oscillator horn, a spray chamber provided with an opening at a tip, a first air supply duct for supplying air into said spray chamber, an ignition device and said oscillator horn furnished in said spray chamber, a wind box forming a combustion space between itself and the spray chamber, said wind box enclosing said spray chamber, a plurality of air supply holes formed in said wind box, facing toward the combustion space, a second air supply duct for supplying air from said air supply hole to the combustion space, and regulating means for regulating said primary and secondary air flows, comprising the steps of:

atomizing fuel using ultrasonic vibration through said oscillator horn;

mixing the atomized fuel with air and igniting; and supplying a fuel-air mixture from the opening of said spray chamber to said combustion space, wherein a change of a primary/secondary air flow ratio decreases an amount of primary air and increases an amount of secondary air at ignition, and increases the amount of primary air and decreases the amount of secondary air at steady combustion.

2. The method according to claim 1 further comprising the step of changing said primary/secondary air flow ratio when spray chamber temperature rises above a predetermined value.

3. The method according to claim 1, further comprising the step of changing said primary/secondary air flow ratio when spray chamber temperature falls below a predetermined value.

4. A combustion apparatus provided with an ultrasonic atomizing device, comprising:

an ultrasonic atomizing device for supplying liquid fuel to an atomizing zone of an oscillator horn;

a spray chamber provided with an opening at a tip;

a first air supply duct supplying primary air into said spray chamber;

said oscillator horn and an ignition device furnished in said spray chamber;

a wind box forming a combustion space between itself and said spray chamber, said wind box enclosing said spray chamber;

a plurality of air supply holes formed in said wind box, facing toward the combustion space;

a secondary air supply duct for supplying secondary air from said plurality of air supply holes to the combustion space; and regulating means for regulating said primary and secondary air flow, wherein fuel atomized by ultrasonic vibration through said oscillator horn is mixed with the primary air and ignited, and an fuel-air mixture is then supplied from the opening of said spray chamber to said combustion chamber.

5. A combustion apparatus provided with an ultrasonic atomizing device, comprising:

an ultrasonic atomizing device for supplying liquid fuel to an atomizing zone of an oscillator horn;

a spray chamber provided with an opening at a tip;

said oscillator horn and an ignition device furnished in said spray chamber;

a wind box, for forming combustion space between itself and said spray chamber, said wind box enclosing said spray chamber;

a plurality of air supply holes formed in said wind box, facing toward the combustion space;

a first air supply duct supplying primary air into said spray chamber;

a secondary air supply duct for supplying secondary air from said air supply holes to the opening of said spray chamber;

a third air supply duct supplying tertiary air from said air supply holes to an area around said spray chamber; and regulating means for regulating said primary and secondary air flow, wherein fuel atomized by ultrasonic vibration through said oscillator horn is mixed with the primary air and ignited, and an fuel-air mixture is then supplied from the opening of said spray chamber to said combustion chamber.

6. The apparatus according to claim 4 or 5, wherein the tip portion of said spray chamber is formed to have a constricted portion.

7. The apparatus according to claim 4 or 5, wherein the plurality of air supply holes provided at positions facing the tip of said spray chamber are arranged in a plurality of rows disposed in a staggered fashion, and portions at both ends of said plurality of rows not opposed to said tip are provided with air holes additional to the air supply holes in the rows.

8. The apparatus according to claim 4 or 5, wherein grooves for preventing droplets from falling are formed on an inner wall surface of said spray chamber.

9. The apparatus according to claim 4 or 5, wherein said combustion space is formed over an entire surface of an outer side of said spray chamber with the exception of a side on which the ultrasonic atomizing device is provided.

10. The apparatus according to claim 4 or 5, wherein a plurality of beams or pins are provided between side walls of said spray chamber.

11. The apparatus according to claim 4 or 5, wherein a freely expandable insulator is provided on both side end portions of side walls of said spray chamber.

12. The apparatus according to claim 4 or 5, wherein forcible cooling means is provided on one of an inner wall and outer wall of said spray chamber.

13. The apparatus according to claim 4 or 5, wherein the tip portion of said spray chamber is formed to having a constricted portion, and an auxiliary air supply duct having air holes is formed on an outer periphery of said constricted portion.

14. The apparatus according to claim 4 or 5, wherein a baffle inclined from an upstream side to a downstream side is disposed within said second air supply duct.

15. The apparatus according to claim 4 or 5, wherein a plurality of tubes are disposed within said second air supply duct and each of said tubes is formed to have said air supply holes.

16. A combustion apparatus according to claim 4 further comprising:

a branch portion of a fuel supply pipe formed adjacent a distal end portion of said ultrasonic atomizing device; and a return pipe having an orifice connected between said branch portion and a fuel tank.

* * * * *